US006953401B2

(12) United States Patent
Starr

(10) Patent No.: US 6,953,401 B2
(45) Date of Patent: Oct. 11, 2005

(54) APPARATUS FOR PRODUCING A FIRE SPECIAL EFFECT

(75) Inventor: Joseph W. Starr, Saugus, CA (US)

(73) Assignee: Technifex Products, LLC, Valencia, CA (US)

( * ) Notice: Subject to any disclaimer, the term of this patent is extended or adjusted under 35 U.S.C. 154(b) by 0 days.

(21) Appl. No.: 10/711,873

(22) Filed: Oct. 11, 2004

(65) Prior Publication Data

US 2005/0101393 A1 May 12, 2005

Related U.S. Application Data

(63) Continuation-in-part of application No. 10/249,949, filed on May 21, 2003, now Pat. No. 6,802,782, which is a continuation-in-part of application No. 10/063,264, filed on Apr. 4, 2002, now Pat. No. 6,685,574.

(51) Int. Cl.[7] ..... A63J 5/02

(52) U.S. Cl. ..... 472/65; 472/66; 40/427

(58) Field of Search ..... 472/57, 61, 65, 472/66; 40/427, 428, 439, 440, 441

(56) References Cited

U.S. PATENT DOCUMENTS

| | | | | |
|---|---|---|---|---|
| 643,493 | A | 2/1900 | Fuller | 472/65 |
| 3,334,816 | A | 8/1967 | Mizuno | 239/18 |
| 3,432,439 | A | 3/1969 | Dickman | 102/334 |
| 4,002,333 | A | 1/1977 | Gotoh | 472/65 |
| 4,026,544 | A | 5/1977 | Plambeck et al. | 472/64 |
| 4,426,021 | A | 1/1984 | Rosenthal | 222/129.1 |
| 4,994,092 | A | 2/1991 | Eklund et al. | 44/629 |
| 5,407,392 | A | 4/1995 | Laijoki-Puska | 472/65 |
| 5,989,128 | A | 11/1999 | Baker et al. | 472/65 |
| 6,363,636 | B1 * | 4/2002 | Hess et al. | 40/428 |
| 6,685,574 | B2 | 2/2004 | Hall | 472/65 |
| 6,802,782 | B2 | 10/2004 | Hall et al. | 472/65 |

FOREIGN PATENT DOCUMENTS

DE 3921407 A1 1/1991

* cited by examiner

*Primary Examiner*—Kien Nguyen
(74) *Attorney, Agent, or Firm*—Holland & Hart LLP; Christopher J. Kulish

(57) ABSTRACT

In one embodiment, the present invention provides a device for producing a fire special effect that is suitable for applications in which the viewers of the simulated flame are able inspect the device from relatively close range and/or from a number of perspectives. For example, the device can be used as a torchiere or wall sconce.

32 Claims, 16 Drawing Sheets

APPARATUS FOR PRODUCING A FIRE SPECIAL EFFECT

CROSS-REFERENCE TO RELATED APPLICATIONS

This application is a continuation-in-part of U.S. patent application Ser. No. 10/249,949, filed May 21, 2003 now U.S. Pat. No. 6,802,782, which is a continuation-in-part of U.S. patent application Ser. No. 10/063,264, filed Apr. 4, 2002 now U.S. Pat. No. 6,685,574, which applications are incorporated by reference into this application in their entireties.

FIELD OF THE INVENTION

The present invention is directed to a special effect device and, in particular, to a device for producing a simulated fire or flame special effect.

BACKGROUND OF THE INVENTION

The use of a simulated fire or flame is desirable in many applications. For instance, in many theme park attractions (e.g., volcano, battle scene and disaster scenes), the use of a simulated flame or fire is preferred relative to a real flame or fire for a number of reasons. To elaborate, a real flame or fire must typically be located a substantial distance from the audience to prevent members of the audience from getting burned. Further, with respect to attractions that are located indoors, a real flame or fire produces heat and smoke that typically require additional air conditioning and ventilation. In contrast, several types of simulated flame or fire effects can be located close to an audience and do not typically impose the air conditioning and ventilation requirements of a real flame or fire.

There are many types of devices for producing simulated flames or fire. For example, one type of device blows strips of colored material, such as silk, up into the air and shines an appropriately colored light onto the strips. From a distance, these devices provide a reasonably convincing simulated flame or fire. At the other end of the spectrum are devices that provide a television or video monitor with a signal of a pre-recorded fire or flame. Such devices are impractical in theme park applications that require a flame or fire that extends over a distance that is greater than the typical video monitor or television. Yet a further type of device involves the use of a screen of atomized water and the projection of an image or light on the screen that creates the illusion of a flame or fire.

SUMMARY OF THE INVENTION

The present invention is directed to a special effect device for producing a simulated flame or fire effect. In one embodiment, the special effect device comprises a console for producing a curtain of steam, which is probably more accurately characterized as a fog, adjacent to an outlet slot or port of a housing. The device further comprises an air modulator for producing a stream of air that is used to vary or modulate the curtain of steam produced by the console. The rising steam in the curtain of steam and the modulation of the curtain of steam closely mimics the dynamic action of an actual flame or fire. The special effect device further comprises lighting that directs a flood of appropriately colored light onto the modulated or undulating curtain of steam. The interaction of the flood of light with the moving curtain of steam yields a simulated flame or fire effect.

In one embodiment, the console comprises a steam manifold that contributes to the production of a curtain of steam with a substantially uniform or desired steam density. In one embodiment, the steam manifold has an elongated body with multiple output ports distributed along the length of the elongated body so that a curtain of steam is produced adjacent to the outlet slot for substantially the length of the console. The steam manifold further comprises an inlet port for receiving steam that is located between the ends of the elongated body. Locating the inlet port in this manner permits several such consoles to be placed end-to-end and, because each console is producing a curtain of steam for substantially the length of the console, a curtain of steam is produced over the extent of the consoles that has a uniform or desired steam density. In contrast, if consoles were utilized in which the steam manifold of one console had to be connected to the steam manifold of the next console by a coupler located between the consoles, there would likely be significant gaps between the curtains of steam produced by each console, thereby preventing a uniform or desired steam density from being achieved over the extent of the consoles. Further, even if a string of consoles could be coupled together so as to eliminate or substantially reduce any gaps in the resulting steam curtain, the ability to achieve a uniform or desired steam density over the extent of the string of consoles is facilitated by locating the inlet port for the steam manifold between the ends of the elongated body of the manifold. To elaborate, if the inlet port was not located between the ends of the elongated body of the manifold, a string of consoles would be coupled to one another and steam would be fed into the string of consoles from one or both of the consoles at the end of the string. In such a configuration, the pressure drop along the length of the string would have to be taken into account to achieve a uniform or desired steam density along the length of the string. This significantly complicates the design of a console, i.e., the need to take into account the effect of the other consoles in a string of consoles. In contrast, by placing an inlet port between the ends of the elongated body of the steam manifold, at least for consoles that are not the end consoles of a string, consoles can be independently designed to produce a uniform or desired steam density without having to take into account the effect of other consoles that are to be in a string of consoles.

In another embodiment, a steam manifold is provided that contributes to the production of a steam curtain with a substantially uniform or desired steam density. The manifold comprises an elongated hollow body with an inlet port for receiving steam and an outlet structure that extends over at least a portion of the length of the hollow body and allows steam to exit with a substantially uniform or desired density. In one embodiment, the outlet structure comprises holes in the elongated body of the manifold that are spaced from one another and/or of a size such that a profile of the resistance to steam exiting from the elongated body decreases with increasing distance from the inlet port. For example, if the inlet port is located at the mid-point of the elongated body, one possible outlet structure has two sets of holes extending in opposite directions from the mid-point of the elongated body with each set of holes having holes that are evenly spaced form one another, circular in shape, and increasing in diameter the further a hole is located from the inlet port.

Another embodiment of the special effect device includes a console for producing a relatively tall curtain of steam, which allows a fire of flame illusion to be produced over a broad range of heights. In one embodiment, the console comprises a housing with an outlet slot or port for venting the steam that produces the curtain or screen of steam. A steam manifold located within the housing employs an outlet structure that presents a relatively low resistance to the flow of steam. As a consequence, the outlet structure of the manifold contributes to the height of the curtain of steam produced adjacent to the outlet port of the housing when the special effect device is in operation. In one embodiment, the steam manifold comprises an elongated body and the outlet structure is a series of holes located between the ends of the elongated body. The holes present a relatively low resistance to the flow of steam when compared to fan nozzles. To elaborate, fan nozzles force any steam passing through the nozzle to traverse a 90 degree turn that reduces the velocity of the steam exiting the nozzle. This reduction in velocity means that the fan nozzle exhibits or is characterized by a relatively high resistance to the flow of steam. A hole or other outlet structure does not require the steam to make a 90 degree turn. Consequently, the steam exits the outlet port of the housing at a higher velocity.

In a further embodiment, the console comprises a housing with air entrainment holes that contribute to the density of the curtain of steam produced adjacent to the outlet slot of the housing during operation. By producing a denser curtain of steam, the visibility of the resulting fire effect is improved or enhanced. The air entrainment holes are located below the outlet structure of a steam manifold located within the housing. In one embodiment, the air entrainment holes are located as far below the outlet structure of the steam manifold as possible.

Another embodiment of the device addresses situations in which target viewers of the illusion are able to inspect the device from relatively close range. For example, certain applications might require a torchiere (i.e., a free-standing structure that supports a flame producing apparatus above the floor) or sconce that target viewers can inspect from relatively close range. In such applications, the condensate produced within the housing during operation of the device typically cannot be allowed to fall on the floor or wall surfaces adjacent to the location of the device. In one embodiment, the device comprises a console for producing a curtain of steam, an air modulator, and a lighting system. The device further comprises a drainage pipe that is capable of conveying condensate that is produced within the housing during operation of the device from a condensate hole in the housing to a distal location. Typically, the distal location is a reservoir or drain that is hidden from the target audience.

In another embodiment of a device that addresses the situation in which target viewers of the illusion are able to inspect the device from relatively close range, a theme surface is located adjacent to the console to create a particular theme for the target viewer. For instance, if the device is to be used to create the illusion of a wall-mounted torch in a medieval castle, the theme surface may be made to look like the wick portion of a such a torch. Alternatively, in some applications, the exterior of the housing may be susceptible to being formed or treated to project a theme surface.

In yet another embodiment of a device that addresses the situation in which target viewers of the illusion are able to inspect the device from relatively close range, the device further comprises a support that is located adjacent to the housing and capable of supporting the drainage pipe in a manner that is not readily visible to the target viewer. In one embodiment, the support is hollow and the drainage pipe is supported within the hollow interior of the support, thereby preventing target viewers from seeing the drain pipe. Typically, a steam pipe for providing steam to the console and electrical conductor for providing electrical power to the air modulator and lighting system are also situated within the hollow support. In yet another embodiment, a theme surface is located adjacent to the support to create a particular theme for the target viewer. To continue with the example of the device being used to create the illusion of a wall-mounted torch in a medieval castle, the theme surface located adjacent to the support is made to look like the wooden handle portion of such a torch. Alternatively, in some applications, the exterior of the housing may be susceptible to being formed or treated to project a theme surface. For example, the support may be made of plastic that has been formed to appear to be the wooden handle of the medieval castle torch.

In many situations in which target viewers of the illusion are able to inspect the device from relatively close range, the air modulator and lighting system cannot be located or mounted on the surfaces normally present, such as floors and walls, and still reasonably maintain the illusion of a flame relative to the various locations from which the target audience is able to view the flame produced by the device. For example, if the device is used to create the illusion of a torchiere, the air modulator and lighting system could typically not be located on the floor without either ruining the illusion for the target audience or allowing the target audience to interfere with the creation of the illusion by interposing themselves between the air modulator or lighting system and the steam console from which the steam or fog emerges. Consequently, in one embodiment, the device comprises a mounting surface that is operatively attached to the console or housing and to which the air modulator and lighting system are also operatively attached. In many applications (e.g., torchieres, sconces, candle holders, candelabras etc.), the mounting surface allows the air modulator and lighting system to be located close to the console, thereby allowing the air modulator and lighting system to be either hidden or camouflaged relative to the target audience.

In yet another embodiment of a device that addresses the situation in which target viewers of the illusion are able to inspect the device from relatively close range, the device further comprises a cover that prevents the target user from viewing one or more of the other elements of the device when the device is in operation. In certain embodiments of the device in which the mounting surface supports the air modulator and/or the lighting system between the housing and the target viewer, the cover is dimensioned so as to prevent a target viewer from viewing the air modulator and/or lighting system and the housing. In many applications the cover also projects a theme surface to the viewer. For example, when the device is used to create the illusion of a torchiere in an ancient Egyptian palace, the cover may be made to look like a large earthen or bronze bowl.

In yet another embodiment, a special effect device is provided for producing a simulated flame or fire effect that utilizes theatrical smoke to produce the effect. Theatrical smoke is atomized glycol or mineral oil that is dispersed into the air and remains suspended in the air for a certain amount of time. Theatrical smoke, unlike steam, does not naturally rise. Consequently, theatrical smoke is commonly used to create "ground fogs" in theatrical productions. In one embodiment, the device comprises a structure for producing a curtain of theatrical smoke. The device is further comprised of an air modulator for producing a stream of air that modulates the curtain of theatrical smoke. Also comprising the device is lighting that operates to direct a flood of light onto the modulated curtain of theatrical smoke.

In a further embodiment, the theatrical smoke-based special effect device comprises a housing with an outlet port that communicates with the ambient atmosphere. The device further comprises a structure for establishing a flow of gas (typically, air) within the housing that is capable of transporting theatrical smoke, which does not naturally rise like steam, to the outlet port and sufficiently above the outlet port to create a curtain of theatrical smoke on which the illusion of a flame or fire can be created. Also comprising the device is a theatrical smoke emission manifold that is substantially located within the housing and further located so as to be disposed within the flow of gas, when the device is in operation. The device further comprises an air modulator and lighting that respectively modulate the curtain of theatrical smoke and light the modulated curtain of theatrical smoke to achieve the simulated flame effect.

Another embodiment of the theatrical smoke-based special effect device comprises a housing with an interior volume. The interior volume is comprised of a chamber and a slot that extends between a slot/chamber junction and an outlet port that communicates with the ambient atmosphere. The device is further comprised of a smoke emission manifold and a gas emission manifold that are both substantially located within the interior volume. The device further comprises an air modulator and lighting that respectively modulate the curtain of theatrical smoke and light the modulated curtain of theatrical smoke to achieve the simulated flame effect. In one embodiment, the smoke emission manifold is located between the outlet port of the slot and the gas emission manifold. In yet a further embodiment, the smoke emission manifold is located between the slot/chamber junction and the gas emission manifold. Yet another embodiment locates the smoke emission manifold so that the manifold cooperates with the housing to define one or more passageways for the flow of gas from the chamber to the outlet port.

A further embodiment of the theatrical smoke-based device comprises a housing, theatrical smoke and gas emission manifolds that are each substantially located within the housing, an air modulator, and a lighting system. Each of the manifolds comprises an inlet port that is located between the ends of the manifold. By locating the inlet ports in this manner, two or more devices can be cascaded together and used to produce a simulated flame or fire effect over substantially the entire length of the devices. In one embodiment, the inlet ports are located at or near the midpoints of the manifolds to facilitate the production of a substantially uniform curtain of theatrical smoke.

Yet another embodiment of the theatrical smoke-based device comprises a housing, theatrical smoke and gas emission manifold that are each substantially located within the housing, an air modulator, and a lighting system. The theatrical smoke manifold comprises a plurality of outlet ports for venting theatrical smoke and that present a desired resistance profile to the flow of theatrical smoke. Similarly, the gas emission manifold comprises a plurality of outlet ports for venting gas and that present a desired resistance profile to the flow of gas. In many cases, the resistance profiles are designed so as to produce a substantially uniform curtain of theatrical smoke.

DETAILED DESCRIPTION

The present invention is directed to a special effect device that utilizes steam to produce a simulated flame or fire effect. Generally, the device includes a steam console for producing a curtain of steam that has a substantially constant or uniform steam density along at least a portion of the length of the console, an air modulator for modulating the curtain of steam produced by the console, and a lighting assembly for illuminating the curtain of steam produced by the console. In operation, illumination of the modulated curtain of steam produced by the console and the air modulator produces a simulated flame effect.

Figure 1:
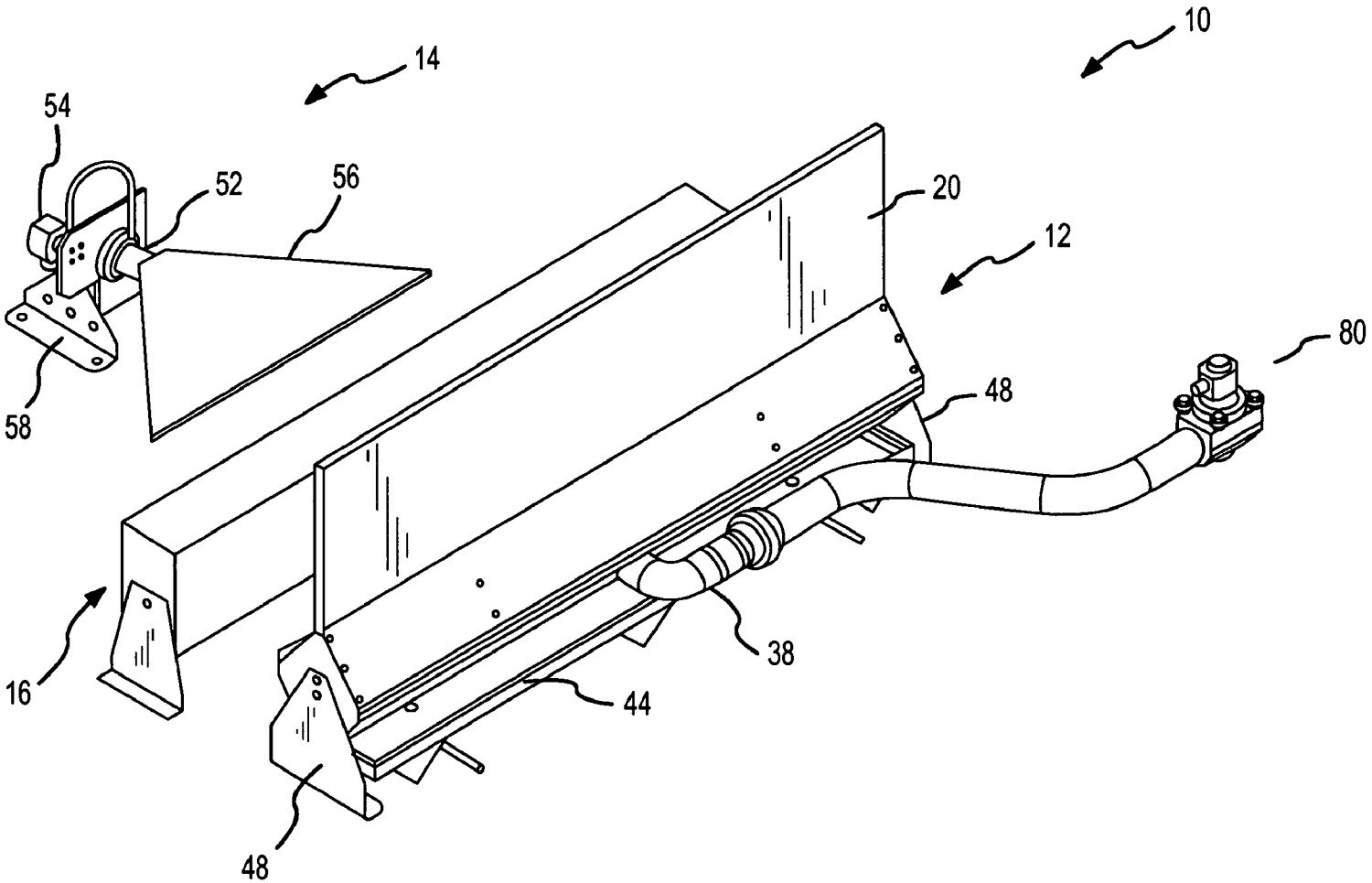
FIG. 1 illustrates an embodiment of a special effect device for producing a simulated flame or fire effect using a steam curtain.
Figure 2A:
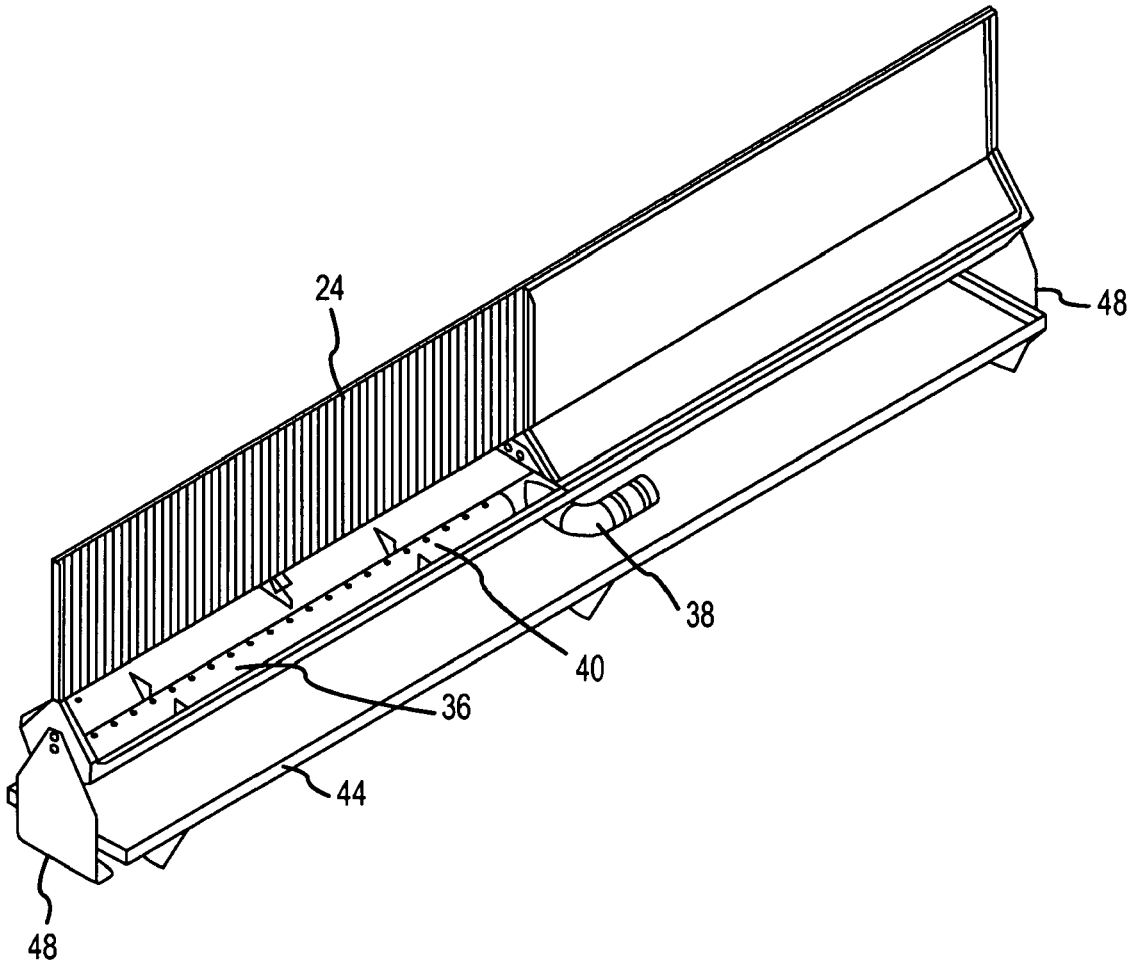
FIG. 2A is a cut away view of the steam console of the device shown in FIG. 1.
Figure 2B:
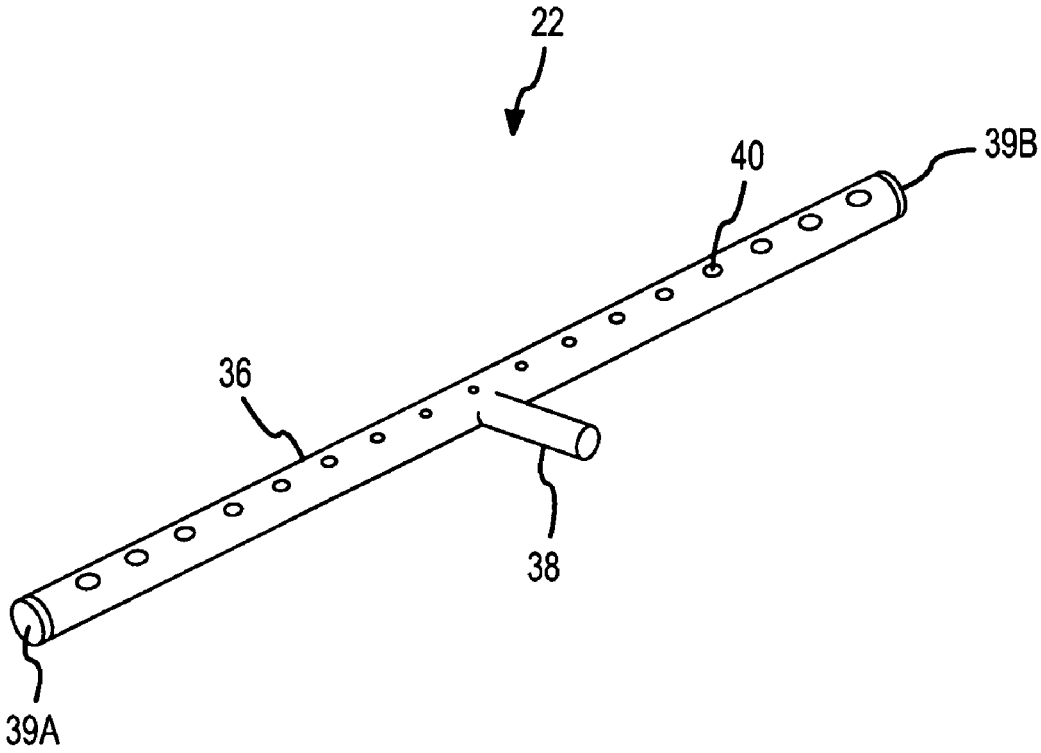
FIG. 2B is a perspective view of the steam emission manifold associated with the steam console of the device shown in FIG. 1.
Figure 3:
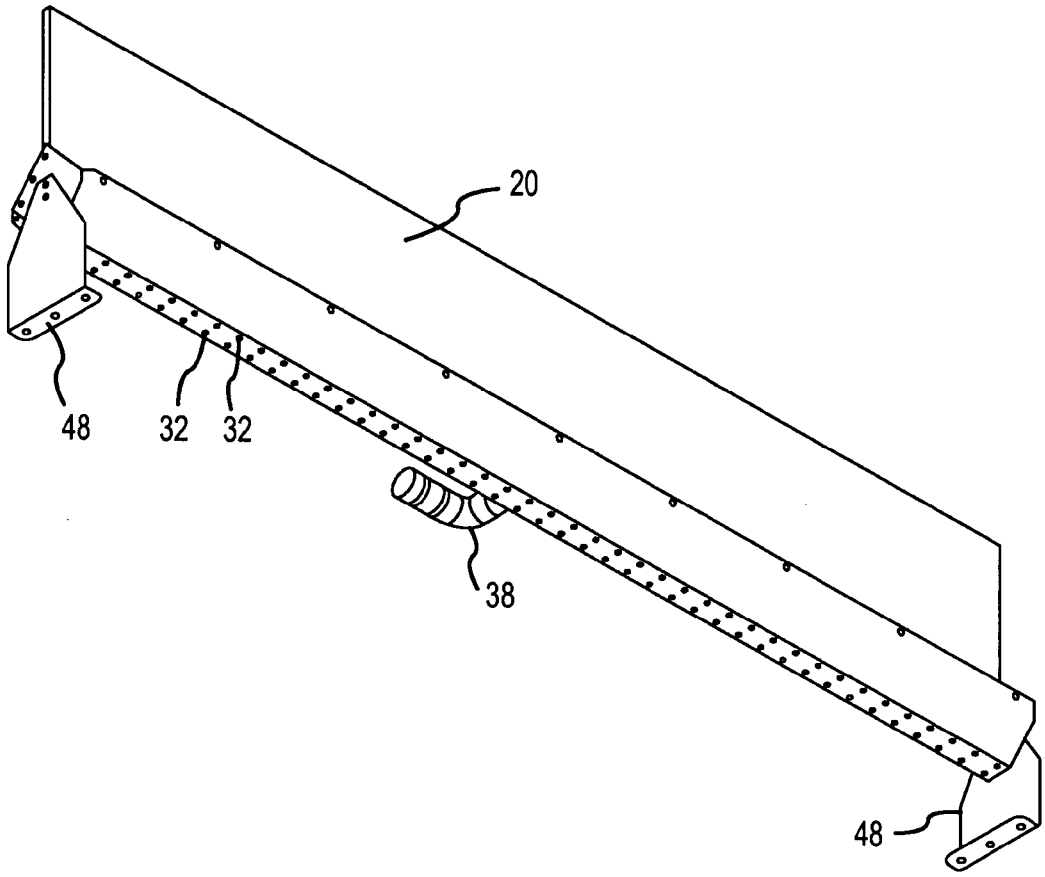
FIG. 3 is a bottom view of the steam console of the device shown in FIG. 1.
Figure 4:
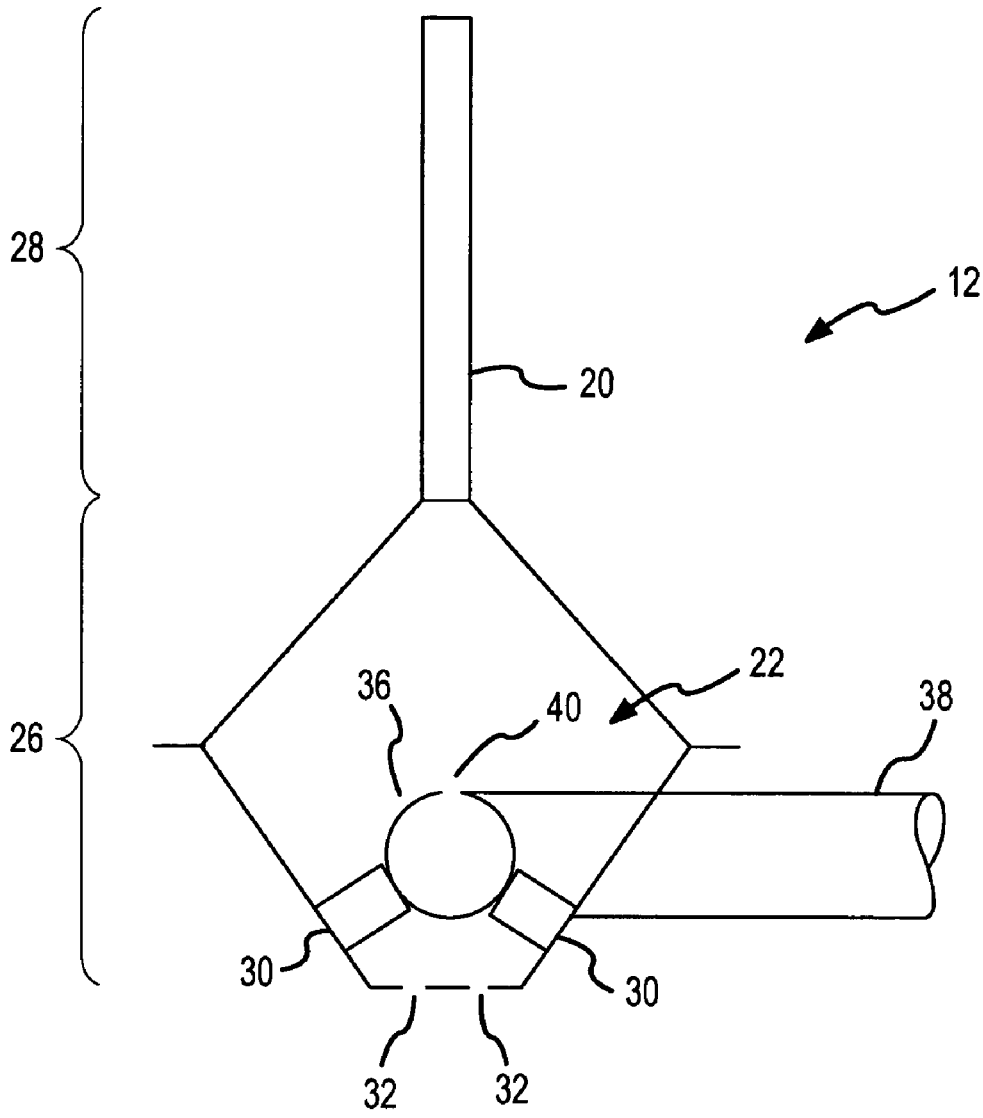
FIG. 4 is a cross-sectional view of the steam console shown in FIG. 1.

FIG. 1 illustrates an embodiment of the special effect device, which is hereinafter referred to as device 10, that uses steam to produce a simulated flame or fire effect. The device 10 comprises a steam console 12 for producing a curtain of steam of substantially uniform steam density along at least a portion of the length of the console, an air modulator 14 for modulating the curtain of steam of that is produced by the console 12, and a lighting assembly 16 for illuminating the modulated curtain of steam produced by the console 12 and air modulator 14 to achieve the simulated flame effect.

With reference to FIGS. 1–4, the steam console 12 comprises housing 20 for holding a steam emission manifold 22 and a flow straightener 24. The housing 20 defines a manifold portion 26 for holding the steam emission manifold 22 and an outlet slot portion 28 for holding the flow straightener 24. Both the manifold portion 26 and the outlet slot portion 28 extend for substantially the length of the console 12. In the illustrated embodiment, the width of the outlet slot portion 28 is ½" to ¾". However, the width can be varied if required by a particular application. The manifold portion 22 comprises several pairs of braces 30 for supporting the steam emission manifold 22. In addition, the manifold portion 26 has a number of air entrainment holes 32 that, during operation, allow air to enter the housing 20 and cool the steam being vented from the steam emission manifold to facilitate the production of the steam curtain adjacent to the outlet slot portion 28.

The steam emission manifold 22 comprises an elongated tube 36 that extends for substantially the entire length of the housing, an inlet port 38 for receiving steam produced by a boiler (not shown) and providing the received steam to the elongated tube 36, and a pair of end caps 39A, 39B that define the ends of the tube 36. The elongated tube 36 has a plurality of holes 40 for allowing steam to vent such that there is a substantially uniform distribution of steam along the length of the tube 36. The substantially uniform distribution of steam is achieved by spacing and/or sizing the holes such that the profile of the resistance of the holes to the flow of steam decreases as the distance from the inlet port 38 increases. In the illustrated embodiment, the distance between adjacent holes is substantially constant. However, the size or diameter of the holes increases with increasing distance from the inlet port 38. In an alternative embodiment, the size or diameter of each of the holes is substantially the same, but the distance between adjacent holes decreases with increasing distance from the inlet port 38. In yet a further embodiment, both the distance between adjacent holes and the size/diameter of the holes vary with the distance from the inlet port 38. The spacing and size of the holes can also be tailored to facilitate the production of a steam curtain with varying steam density (e.g., greater steam density in the middle of the console and lesser density at the ends of the console).

The holes 40 facilitate the production of a tall steam curtain adjacent to the outlet slot portion 28 of the housing. To elaborate, in an embodiment of a steam emission manifold that uses a nozzle instead of a hole, the structure of the nozzle typically requires the steam to change direction between the elongated tube and the exit port of the nozzle. In the case of a fan nozzle, the steam typically has to travel around a 90 degree bend in passing between the elongated tube and the exit port of such a nozzle. Such changes in direction reduce the velocity of the steam being vented from the steam emission manifold and, as a consequence, reduce the height of the steam curtain produced adjacent to the outlet slot portion of the housing. In contrast, a hole does not require the steam to change direction and, therefore, facilitates the production of a tall curtain of steam.

The elongated tube 36 is oriented in the housing 20 such that the plurality of holes 40 lie along a substantially straight line that lies substantially in a plane defined by the outlet slot portion 28. This orientation of the holes 40 relative to the outlet slot portion 28 also facilitates the production of a tall curtain of steam. To elaborate, in an embodiment in which the venting structure associated with the steam emission manifold does not vent the steam in the plane defined by the outlet slot portion, the steam is required to change directions between the vent and the outlet slot portion. This change in direction reduces the velocity of the steam and, relatedly, the height of the curtain of steam produced adjacent to the outlet slot portion 28. In contrast, by locating the holes 40 substantially directly under the outlet slot portion 28, the steam venting from the holes 40 follows a substantially straight path between the holes 40 and the outlet slot portion 28. Consequently, the steam does not have to change direction and the velocity of the steam exiting the outlet portion 28 is greater than it would be if the steam had to change direction. This greater velocity, in turn, facilitates the production of a tall curtain of steam.

Figure 5A:
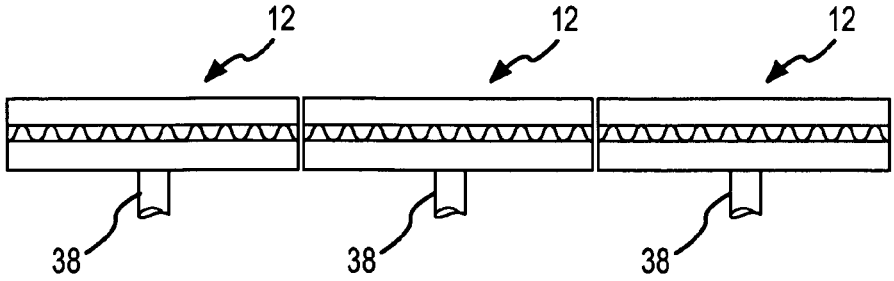
FIGS. 5A–5C respectively illustrate a series of consoles of the type shown in FIG. 1 located end-to-end, a console of the type shown in FIG. 1 located end-to-end with a console having an inlet port situated at the end of the console, and a console of the type shown in FIG. 1 located end-to-end with consoles that each have an inlet port situated at the end of the console.
Figure 5B:
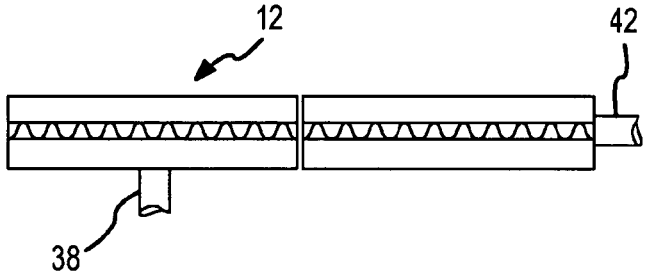
Figure 5C:
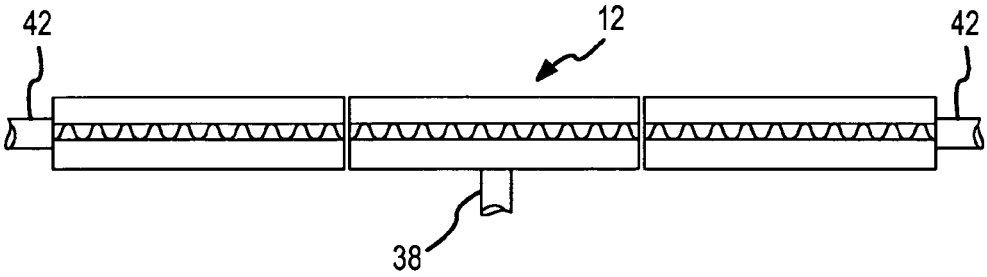

The inlet port 38 is located between the ends of the elongated tube 36. In the illustrated embodiment, the inlet port 38 is located at substantially the mid-point between the ends of the tube 36. By locating the inlet port 38 between the ends of the tube 36, the console 12 can be placed end-to-end with one or more consoles with similarly located inlet ports to achieve a substantially continuous simulated flame or fire effect over the length of the consoles, as shown in FIG. 5A. Alternatively, the console 12 is placed end-to-end with a console that has an inlet port 42 located at one end of its steam emission manifold to achieve a substantially continuous simulated flame effect over the length of the two consoles, as shown in FIG. 5B. In yet another alternative, the console 12 is placed end-to-end with two consoles that each have an inlet port 42 located at one end of a steam emission manifold to achieve a simulated flame or fire effect over the length of three consoles, as shown in FIG. 5C. The inlet port 38 can be placed at locations between the ends of the tube 36 other than the mid-point and still provide the ability to place the console 12 end-to-end with other consoles. Generally, however, if a steam curtain is to be produced along the length of the console 12, the location of the inlet port 38 is chosen so as not to interfere with the venting of steam from the tube 36. Further, it should be appreciated that the location of the inlet port 38 impacts the distribution and/or sizing of the holes 40 if a uniform steam density or varied steam density profile is desired. In addition, it should also be appreciate that by placing the inlet port 38 between the ends of the elongated tube 36, the design of a fire special effect that requires a string of consoles is significantly simplified. To elaborate, by locating the inlet port 38 between the ends of the elongated tube 36, a uniform or desired steam density for the console 12 can be designed without having to take into account the effect of other consoles in a string of consoles.

Figure 6A:
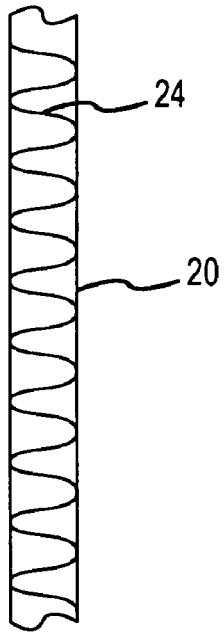
FIG. 6 illustrates two possible types of flow straighteners for use in the steam console shown in FIG. 1.
Figure 6B:
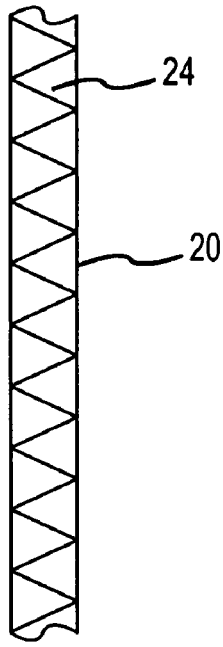

The flow straightener 24, absent the application of the air modulator 14, facilitates the production of a relatively smooth curtain of steam, i.e., the steam adjacent to the outlet slot portion 28 flows substantially directly upward. The flow straightener 24 also strives to reduce condensation that, in turn, reduces the amount of steam available to produce the curtain of steam. To elaborate, a flow straightener in the form of "honeycomb" (hexagonal cells) has a relatively high surface area that promotes condensation and, as a consequence, reduces the steam available to produce the curtain of steam. By utilizing a flow straightener with less surface area relative to a "honeycomb" flow straightener, condensation is reduced. Two possible configuration for the flow straightener 24 that have less surface area than a hexagonal flow straightener are the sinusoidal or triangular configuration respectively shown in FIGS. 6A and 6B. Other configurations are also feasible. The flow straightener 24 is preferably made of stainless steel, which has been found to be easier to clean and capable of withstanding the heat of the steam. However, other materials, such as plastic and fiberglass, are also feasible.

The steam console 12 further comprises a condensate collection tray 44 for collecting water that condenses within the housing 20 and flows out the air entrainment holes 32 of the housing. In certain applications, the condensate collection tray 44 is not needed. For example, if the housing 20 is located on a floor or substrate that is capable of draining water, the condensate collection tray 44 may not be necessary.

The steam console 12 also comprises a pair of brackets 48 for attaching the housing 20 to a floor, substrate or frame.

The air modulator 14 produces a varying sheet-like current of moving air that is directed at the curtain of steam produced by the steam console 12. The air modulator 14 is comprised of a fan 52 (e.g., blower, squirrel-cage blower, shaded pole blowers etc.), an electromechanical device 54 for modulating the stream of air produced by the fan 52, and a fan nozzle 56 for distributing the modulated air substantially across the extent of the outlet slot portion 28. A bracket assembly 58 facilitates attachment of the air modulator 14 to a floor, substrate or frame. In the illustrate embodiment, the electromechanical device 54 is a device that rotates a disk with one or more holes in front of the intake of the fan 52 to facilitate the production of the varying current of moving air. Other devices for varying the flow of air on the intake or output side of the fan 52 or similar device are feasible. As an alternative to the fan 52, a compressed air driven "air amplifier" or air amplified blower/exhausters, such as those made by Coppus and Exair, can be used to produce the current of moving air.

Figure 7:
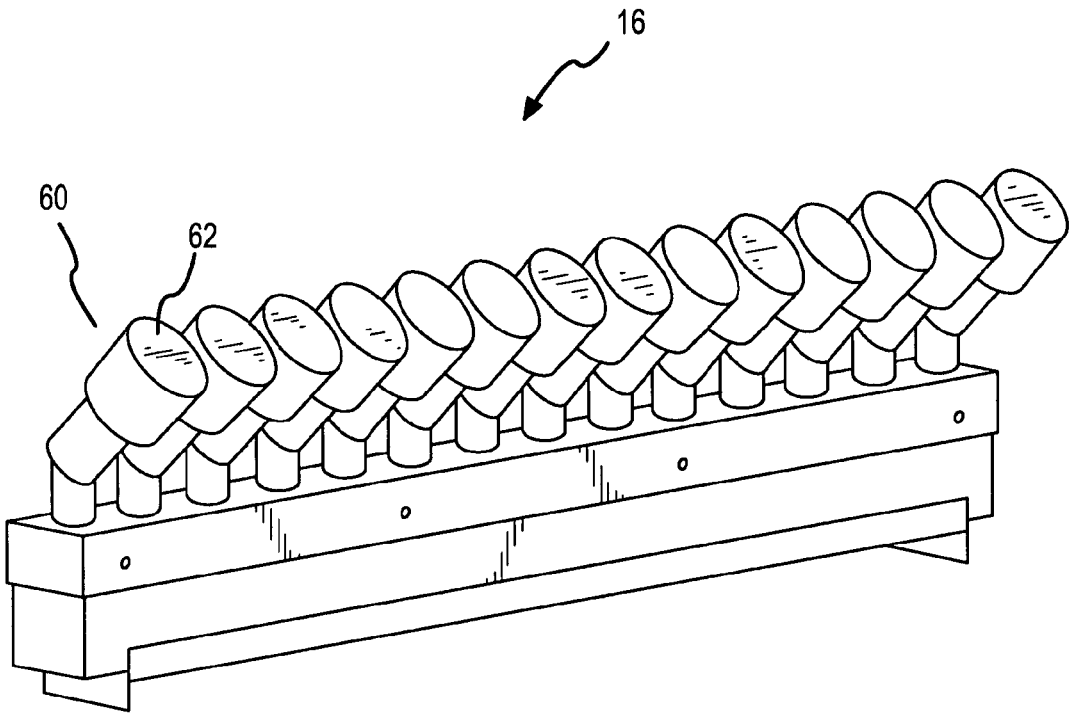
FIG. 7 illustrates the lighting assembly employed in the embodiment of the device shown in FIG. 1.

With reference to FIG. 7, the lighting assembly 16 produces the light that is directed to the modulated curtain of steam produced by the steam console 12 and air modulator 14 to produce the flame or fire special effect. The lighting assembly 16 is comprised of a lights 60 with each light having a colored filter 62. Each of the color filters is typically a combination of red, orange, yellow and sometimes blue color filters that are pieced together in a manner that when light is shown through them the colors of a flame are produced in a naturally occurring sequence, (e.g. red at the bottom, followed by orange, and yellow at the top). Flicker devices are used to modulate the intensity of the lights 60. In one embodiment, there is a flicker device associated with each of the lights 60 so that the lights to not flicker in synchronism but rather flicker in a quasi-random manner.

Other lighting structures are also feasible. For example, a lighting structure that employs different colored lights is feasible. Further, any lighting assembly is capable of being adapted to facilitate the production of flame or fire images of colors other than the previously noted red, orange, yellow and blue colors. For example, a lighting assembly can be adapted for the production of a flame or fire image in which the image is comprised of various shades of green. Yet another possible lighting structure is a projector that, during operation, projects a video image of a fire onto the screen.

Figure 8A:
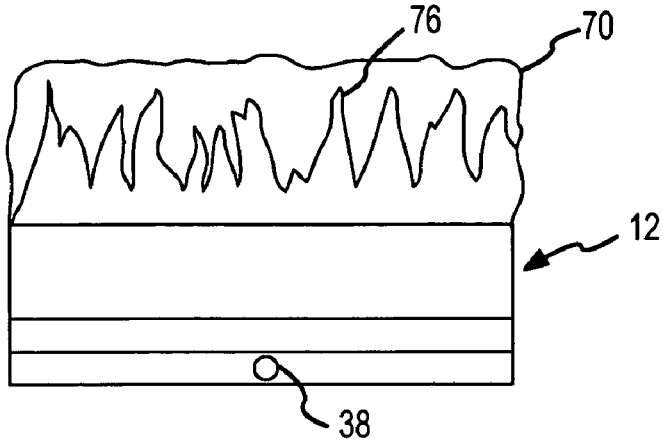
FIGS. 8A–8C respectively are rear, side and top views of the device shown in FIG. 1.
Figure 8B:
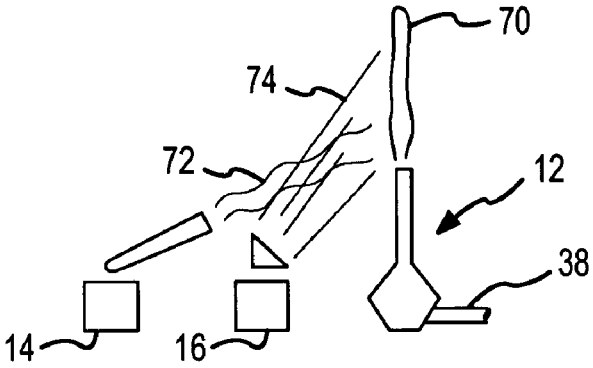
Figure 8C:
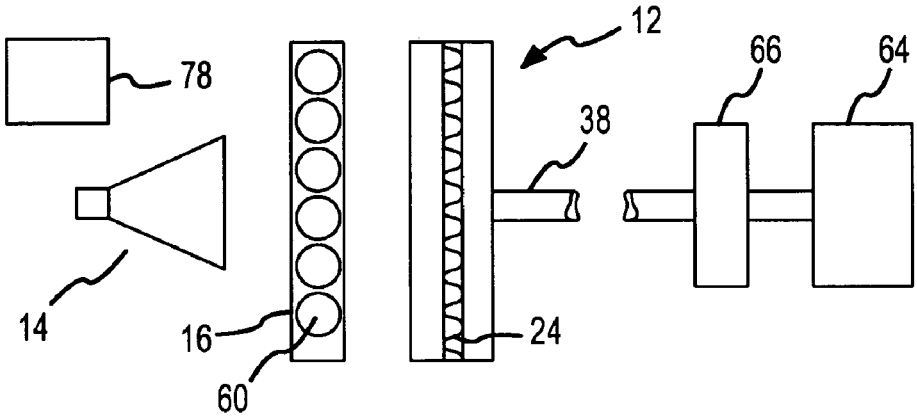

With reference to FIGS. 8A–8C, the operation of the device 10 is described. A boiler 64 produces the steam that is used by the console 12 to produce a steam curtain. Typically, the pressure of the steam produced by the boiler 64 is 2–5 psi. However, the device 10 can be adapted to operate at other pressure ranges, if needed. A main manifold 66 serves to output the steam produced by the boiler 64 to one or more of the consoles 12 at substantially equal and desired pressures for operation of the consoles 12. Provided the steam lines between the main manifold 66 and each of the consoles present substantially equal thermodynamic losses, the consoles 12 each receive steam at substantially the same pressure and temperature. In the embodiment illustrated in FIGS. 8A–8C, since there is only one console 12, the main manifold 66 could be eliminated if the boiler 64 is susceptible to appropriate regulation.

In any event, the steam produced by the boiler 64 is received at the inlet port 38 of the console 12 and distributed along the length of the elongated tube 36. The steam is vented from the tube 36 via the holes 40 such that there is substantially even distribution of steam along the length of the tube 36. The steam venting from the holes 40 mixes with the relatively cooler air that is entering the manifold portion 26 of the housing 20 by the air entrainment holes 32. The mixing of the steam with the cooler air promotes condensation and the densification of the resulting "steam" curtain produced adjacent to the outlet slot portion 28. After mixing with the cooler air, the steam passes through the flow straightener 24 and exits the console adjacent to the outlet slot portion 28. Absent the operation of the air modulator 14, a steam/fog curtain 70 is produced adjacent to the outlet slot portion 28.

The mixing of the steam vented from the tube 36 with the cooler air and flow straightener 24 promote condensation that results in some of the steam being converted to water droplets that are too massive to be ejected from the outlet slot portion 28 of the housing 20. Many of these water droplets drain through the air entrainment holes 32 and are collected in the condensation tray 44.

The air modulator 14 produces a varying current of air 72 that modulates the curtain of steam/fog produced by the console 12 in a manner that closely simulates the action of a flame or fire.

The lighting assembly 16 produces a flood of light 74 that interacts with the modulated steam/fog curtain produced by the operation of the console 12 and the air modulator 14 to produce a simulated flame or fire effect 76.

A control and electrical power distribution system 78 distributes power to the air modulator 14 and the lighting assembly 16. The system 78 also includes the electronic circuitry for causing the lights of the lighting assembly to flicker or change in intensity. Further, the system 78 controls a solenoid 80 (FIG. 1) that permits a user to selectively or controllably apply steam from the boiler 64 to the console 12. The ability to control the application of steam to the console 12 also impacts the height of the resulting curtain of steam, i.e., the greater the pressure of the steam applied to the console 12, the greater the height of the resulting curtain of steam produced adjacent to the outlet slot portion 28.

A number of modifications to the device 10, in addition to any already noted, are feasible. For instance, the air entrainment holes 32 could be eliminated and a steam/fog curtain produced. However, without the pre-cooling of the air that enters through the holes 32, the cooling of the steam would primarily occur after the steam was vented from the outlet slot portion 28. As a consequence, the steam/fog curtain would form further from the outlet slot portion 28 than it would otherwise, which may be undesirable in certain applications. The relative positions of the console 12, air modulator 14 and lighting assembly 16 can be changed from those shown in the drawings to address particular applications of the device 10. Further, while many of the elements of the console 12 are linear in nature, curved elements are also feasible. For example, a curved tube can replace the tube 36. Further, the holes along such a curved tube for venting the steam can be positioned to lie in a curved plane that is defined by a curved outlet slot portion that houses a curved flow straightener. Another possible modification is to use a slot rather than the holes 40 to achieve the desired profile for resistance to the flow of steam.

A further embodiment of a special effect device that produces a simulated flame or fire effect utilizes theatrical smoke, rather than steam. Generally, the device includes a console for producing a curtain of theatrical smoke that has a substantially constant or uniform density along at least a portion of the length of the console, an air modulator for modulating the curtain of theatrical smoke produced by the console, and a lighting assembly for illuminating the curtain of theatrical smoke produced by the console. In operation, illumination of the modulated curtain of theatrical smoke produced by the console and the air modulator produces a simulated flame effect.

Figure 9:
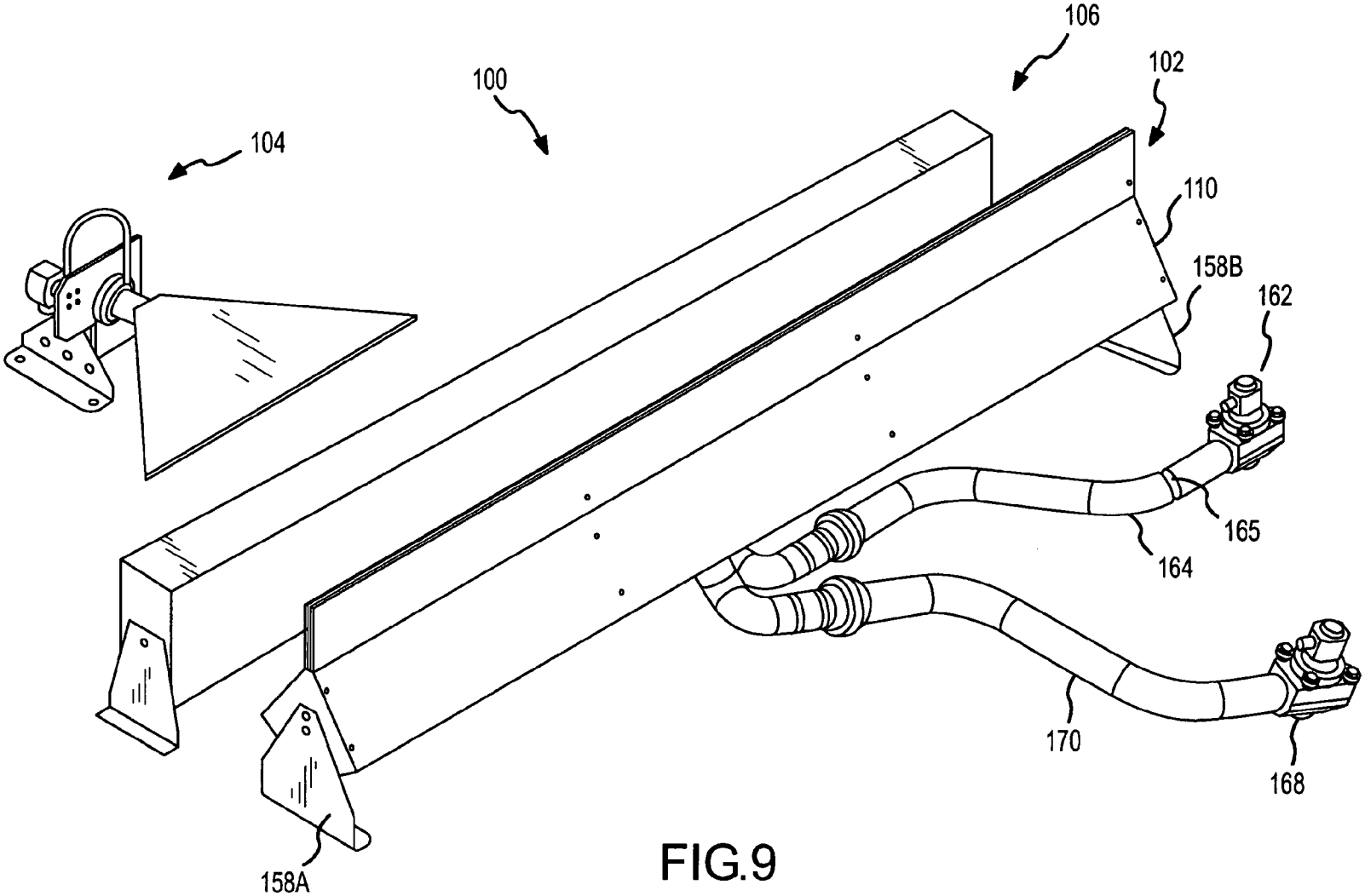
FIG. 9 illustrates an embodiment of a special effect device for producing a simulated flame or fire effect using theatrical smoke.

FIG. 9 illustrates an embodiment of the special effect device, which is hereinafter referred to as device 100, that uses theatrical smoke to produce a simulated flame or fire effect. The device 100 comprises a theatrical smoke console 102 for producing a curtain of theatrical smoke of substantially uniform theatrical smoke density along at least a portion of the length of the console, an air modulator 104 for modulating the curtain of theatrical smoke that is produced by the console 102, and a lighting assembly 106 for illuminating the modulated curtain of theatrical smoke produced by the console 102 and air modulator 104 to achieve the simulated flame effect.

Figure 10:
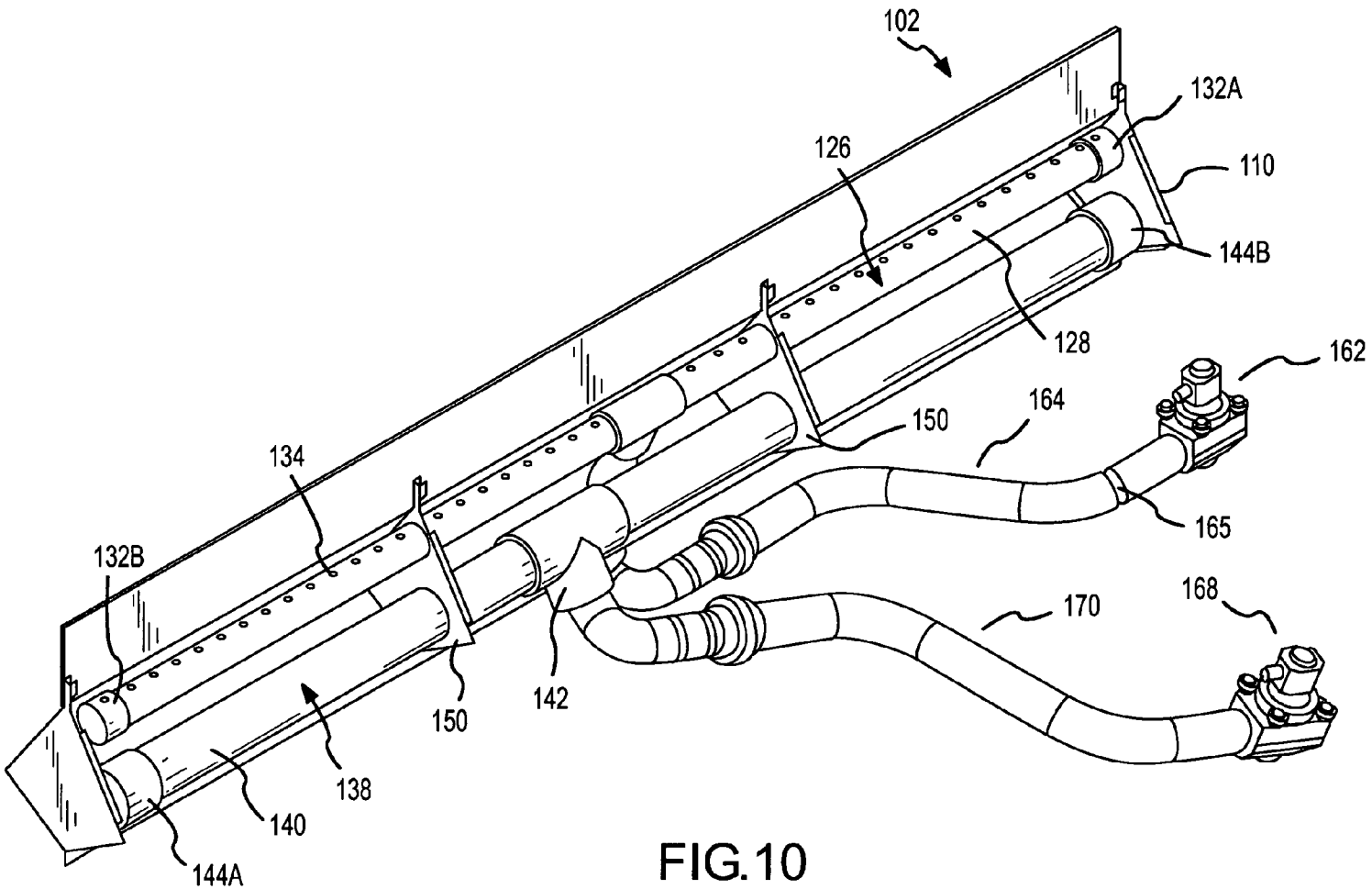
FIG. 10 is a cut away view of the theatrical smoke console of the device shown in FIG. 9.
Figure 11:
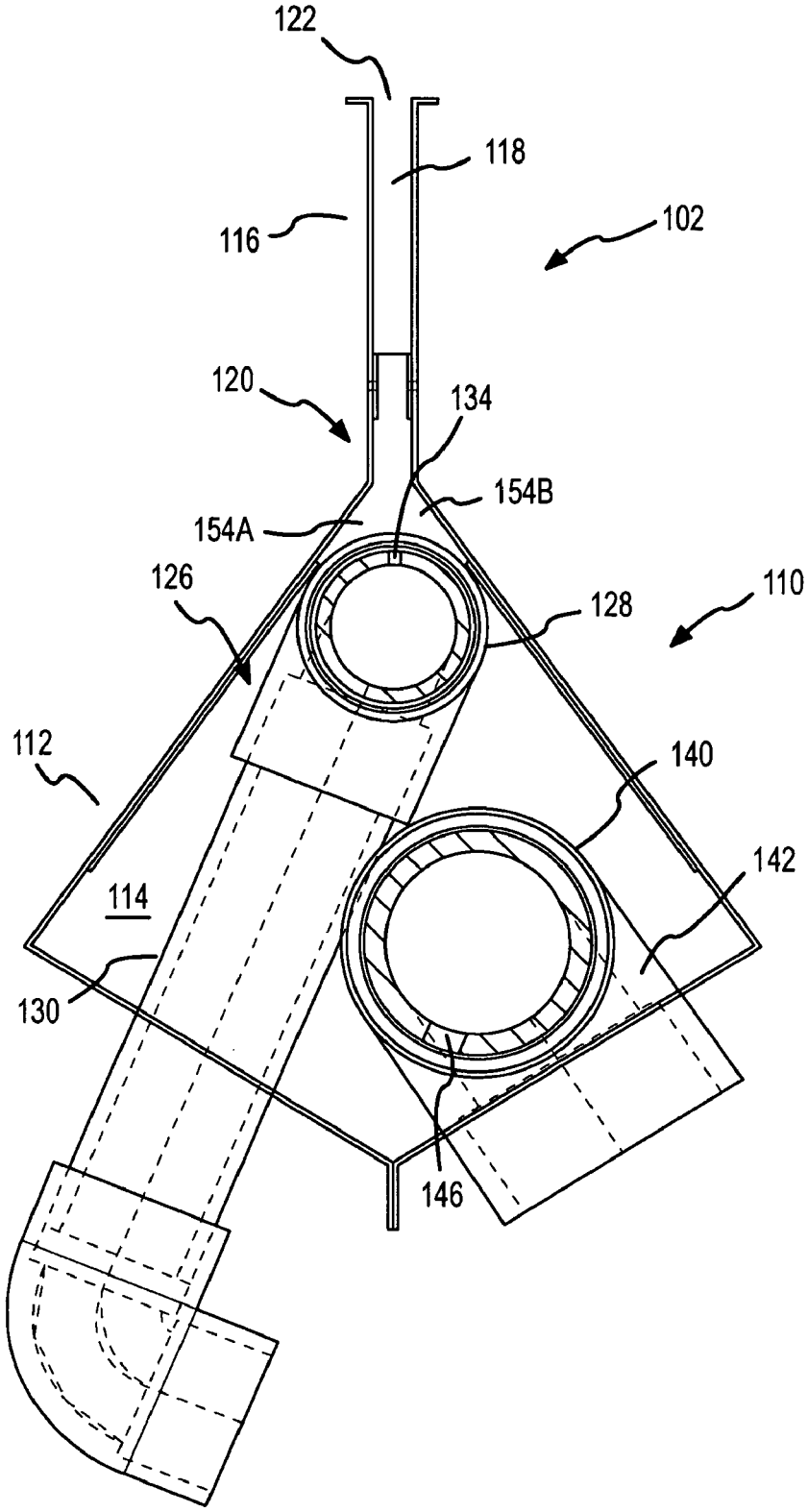
FIG. 11 is a cross-sectional view of the theatrical smoke console shown in FIG. 9.

With reference to FIGS. 9–11, the theatrical smoke console 102 comprises a housing 110 that is shaped so as to direct a gas (typically, air) and entrained theatrical smoke so as to form a curtain of theatrical smoke. The housing 110 comprises a first portion 112 that defines a chamber 114 and a second portion 116 that defines a slot 118. The slot 118 extends from a slot/chamber junction 120 to an outlet port 122.

The first portion 112 of the housing 110 is a substantially closed surface that forms a plenum within which sufficient gas pressure can be produced to push or direct at least some of the gas through slot 118. Alternatively, a perforated or open surface can be used to funnel or direct gas from a blower such that at least a portion of the gas flows through the slot 118. In the illustrated embodiment, the first portion 112 extends the length of the console 102 to facilitate the production of a substantially continuous simulated flame when two or more consoles are cascaded together. If such an effect is not needed, the first portion 112 need not extend the length of the console 112. The first portion 112 also has a diamond-like cross-section that is approximately 8" wide and 8" high. Other shapes and dimensions are feasible. Further, the first portion 112 extends between the ends of a console 102 along a substantially straight line. If needed, the first portion 112 can be fabricated to follow a curved path or a path that is a combination of straight and curved sections.

The second portion 116 of the housing 110, which defines the slot 118 through which the gas and entrained smoke pass, serves to shape the gas and entrained smoke so that a curtain of theatrical smoke is formed above the outlet port 122. The height of the slot 118 is a compromise between having a slot of sufficient length to form a suitable curtain and the need to limit the mixing of the gas and the theatrical smoke to prevent dilution of the theatrical smoke. In the illustrated embodiment, the height of the slot 118 is approximately 4". Other height slots are also feasible. The width of the slot 118 is also chosen so as that a suitable curtain is formed. In the illustrated embodiment, the width of the slot is approximately ⅜". A slot with a different width is also feasible. The slot 118 extends the length of the console 102 to facilitate the production of a substantially continuous flame when two or more consoles are cascaded together. If such an effect is not needed, the second portion 116 need not extend the length of the console 102. Further the second portion 116 extends between the ends of the console 102 along a substantially straight line. If needed, the second portion 116 can be fabricated to follow a curved path or a path that is a combination of straight and curved sections.

The console 102 is further comprised of a theatrical smoke emission manifold 126 for providing the theatrical smoke to the interior of the housing 110. The manifold 126 comprises an elongated tube 128, an inlet port 130 for receiving theatrical smoke produced by a theatrical smoke generator (not shown) and providing the received theatrical smoke to the elongated tube 128, and a pair of end caps 132A, 132B that define the ends of the tube 128. The elongated tube 128 has a plurality of holes 134 for allowing theatrical smoke to vent such that there is a substantially uniform distribution of theatrical smoke along the length of the tube 128. The substantially uniform distribution of theatrical smoke is achieved by spacing and/or sizing the holes 134 such that the profile of the resistance of the holes to the flow of theatrical smoke decreases as the distance from the inlet port 130 increases. For a substantially constant distance between adjacent holes, a substantially uniform distribution of theatrical smoke is achieved when the size or diameter of the holes increases with increasing distance from the inlet port 130. In an alternative embodiment, the size or diameter of each of the holes is substantially the same, but the distance between adjacent holes decreases with increasing distance from the inlet port 130. In yet a further embodiment, both the distance between adjacent holes and the size/diameter of the holes vary with the distance from the inlet port 130. In the illustrated embodiment, a substantially uniform distribution of theatrical smoke is achieved with a substantially constant distance between adjacent holes and a substantially constant hole size. To elaborate, both the length of the manifold 126 and the anticipated pressure of the theatrical smoke within the manifold 126 are substantial factors in determining the distance between adjacent holes and the size of the holes needed to achieve a substantially uniform distribution of theatrical smoke. In the illustrated embodiment, the manifold 126 is relatively short and the pressure of theatrical smoke is expected to be relatively high. In such a case, a substantially uniform distribution of theatrical smoke is achievable with substantially constant spacing between adjacent holes and holes of substantially constant size. The spacing and size of the holes can also be tailored to facilitate the production of a theatrical smoke curtain with varying theatrical smoke density (e.g., greater theatrical smoke density in the middle of the console and lesser density at the ends of the console).

The tube 128 extends the length of the console 102 to facilitate the production of a substantially continuous simulated flame when two or more consoles are cascaded together. If such an effect is not needed, the tube 128 need not extend the length of the console 112. In the illustrated embodiment, the tube 128 has a circular cross-section and a diameter of 2". Tubes with different cross-sectional shapes and dimensions are also feasible. Further the tube 128 extends between the ends of the console 102 along a substantially straight line. If needed, the tube 128 can be fabricated to follow a curved path or a path that is a combination of straight and curved sections.

The console 102 is further comprised of a gas emission manifold 138 for providing the gas (typically, air) to the interior of the housing 110 that is used to create a stream of gas for transporting the theatrical smoke provided by manifold 126 to the outlet port 122. The manifold 138 comprises an elongated tube 140, an inlet port 142 for receiving gas produced by a gas generator (not shown), such as a blower or fan, and providing the received gas to the elongated tube 140, and a pair of end caps 144A, 144B that define the ends of the tube 140. The elongated tube 140 has a plurality of holes 146 that extend along the length of the tube 140 for allowing gas to vent such that there is a substantially uniform distribution of gas along the length of the tube 128. The substantially uniform distribution of gas is achieved by spacing and/or sizing the holes 146 such that the profile of the resistance of the holes to the flow of gas decreases as the distance from the inlet port 142 increases. For a substantially constant distance between adjacent holes, a substantially uniform distribution of gas is achieved when the size or diameter of the holes increases with increasing distance from the inlet port 142. In an alternative embodiment, the size or diameter of each of the holes is substantially the same, but the distance between adjacent holes decreases with increasing distance from the inlet port 142. In yet a further embodiment, both the distance between adjacent holes and the size/diameter of the holes vary with the distance from the inlet port 142. In the illustrated embodiment, a substantially uniform distribution of gas is achieved with a substantially constant distance between adjacent holes and a substantially constant hole size. To elaborate, both the length of the manifold 138 and the anticipated pressure of the gas within the manifold 138 are substantial factors in determining the distance between adjacent holes and the size of the holes needed to achieve a substantially uniform distribution of gas. In the illustrated embodiment, the manifold 138 is relatively short and the pressure of the gas is expected to be relatively high. In such a case, a substantially uniform distribution of gas is achievable with substantially constant spacing between adjacent holes and holes of substantially constant size. The spacing and size of the holes can also be tailored to facilitate the production of a gas curtain with varying gas density (e.g., greater gas density in the middle of the console and lesser density at the ends of the console).

The tube 140 extends the length of the console 102 to facilitate the production of a substantially continuous simulated flame when two or more consoles are cascaded together. If such an effect is not needed, the tube 140 need not extend the length of the console 112. In the illustrated embodiment, the tube 140 has a circular cross-section and a diameter of 3". Tubes with different cross-sectional shapes and dimensions are also feasible. Further the tube 140 extends between the ends of the console 102 along a substantially straight line. If needed, the tube 140 can be fabricated to follow a curved path or a path that is a combination of straight and curved sections.

The inlet port 130 is located between the ends 132A, 132B of the elongated tube 128. Likewise, the inlet port 142 is located between the ends 144A, 144B of the elongated tube 140. In the illustrated embodiment, the inlet port 130 is located at substantially the mid-point between the ends 132A, 132B of the tube 128 and the inlet port 142 is located at substantially the mid-point between the ends 144A, 144B of the tube 140. By locating the inlet ports 130, 142 between the ends of their respective tubes, the console 102 can be placed end-to-end with one or more consoles with similarly located inlet ports to achieve a substantially continuous simulated flame or fire effect over the length of the consoles. This ability was illustrated with respect to the steam embodiment of the device in FIG. 5A. Alternatively, the console 102 is placed end-to-end with a console that has an inlet port that is located at one end of its gas emission manifold to achieve a substantially continuous simulated flame effect over the length of the two consoles. This ability was illustrated with respect to the steam embodiment of the device in FIG. 5B. In yet another alternative, the console 102 is placed end-to-end with two consoles that each have an inlet port located at one end of a gas emission manifold to achieve a simulated flame or fire effect over the length of three consoles. This ability was illustrated with respect to the steam embodiment of the device in FIG. 5C.

The inlet ports 130, 142 can each be placed at a location other than the mid-point of the tube with which each is associated and still provide the ability to place the console 102 end-to-end with other consoles. Generally, however, if a theatrical smoke curtain is to be produced along the length of the console 102, the location of the inlet ports is chosen so as not to interfere with the venting of theatrical smoke from the tube 128. Further, it should be appreciated that the location of the inlet port 130 impacts the distribution and/or sizing of the holes 134 if a gas stream with entrained theatrical smoke and a uniform or varied density profile is desired. Likewise, the location of the inlet port 142 impacts the distribution and/or sizing of the holes 146 if a gas stream with entrained theatrical smoke and a uniform or varied density profile is desired. In addition, it should also be appreciate that by placing the inlet ports 130, 142 between the ends of the elongated tube with which each is associated, the design of a fire special effect that requires a string of consoles is significantly simplified. To elaborate, by locating the inlet ports 130, 142 between the ends of the elongated tube with which each is associated, a console 102 that produces a gas stream with entrained theatrical smoke with a desired density profile can be designed without having to take into account the effect of other consoles in a string of consoles.

The theatrical smoke emission manifold 126 and the gas emission manifold 138 are supported within the housing 110 by mounting brackets 150. A separate mounting bracket or set of mounting brackets for each of the manifolds is also feasible.

The elongated tube 128 of the theatrical smoke emission manifold 126 and the elongated tube 140 of the gas emission manifold 138 are positioned within the housing so that the holes of the tube 128 are located between the outlet port 122 and the holes 146 of the tube 140. This positioning generally assures that the theatrical smoke output through the holes 134 of the theatrical smoke emission manifold 126 will enter a stream of gas that is headed to the output port 122 rather being entrained in a stream of turbulent gas that would dilute the theatrical smoke. In the illustrated embodiment, the tube 126 is positioned adjacent to the slot/chamber junction 120, a location at which substantially all of the gas moving by the tube 126 is likely to be headed to the output port 122. Further, the tube 128 is located such that a pair of flow paths 154A, 154B are defined that merge into the slot 118. Alternatively, depending upon the size of the tube 128 and the slot 118, the tube 128 can be located within the slot 118.

The elongated tube 128 of the theatrical smoke emission manifold 126 is also oriented within the housing 110 such that the plurality of holes 134 lie along a substantially straight line that lies substantially in a plane defined by the outlet slot 118. Further, the holes 134 are located so that the theatrical smoke exiting the holes 134 during operation flows in a substantially straight line towards the outlet port 122. This orientation of the holes 134 reduces the time that the theatrical smoke is entrained in the gas stream within the housing 110 and increases the height of the curtain that can be achieved adjacent to the outlet port 122.

The elongated tube 140 of the gas emission manifold 138 is oriented within the housing 110 such that the plurality of holes 146 face in a direction that allows the chamber 114 to create a substantially uniform gas pressure along the length of the chamber and, as a consequence, a relatively uniform flow through the slot 118. If the holes 146 directly faced the slot/chamber junction 120, the flow of gas through the slot would likely be non-uniform with more gas flowing in the portions of the slot 118 adjacent to a hole than and less gas flowing in the portions of the slot 118 between holes.

The theatrical smoke console 102 also comprises a pair of brackets 158A, 158B for attaching the housing 20 to a floor, substrate or frame.

The air modulator 104 produces a varying sheet-like current of moving air that is directed at the curtain of theatrical smoke produced by the theatrical smoke console 102. The air modulator 104 is substantially identical to the previously described air modulator 14. As a consequence, the air modulator 104 and alternatives thereto are not described further.

The lighting assembly 106 produces the light that is directed to the modulated curtain of theatrical smoke produced by the theatrical smoke console 12 and air modulator 14 to produce the flame or fire special effect. Since the lighting assembly 106 is substantially identical to the previously described lighting assembly 16, the lighting assembly 106 and alternatives thereto are not described further.

The operation of the device 100 involves using the console 102 to produce a curtain of theatrical smoke adjacent to the outlet port 122; using the air modulator 104 to produce a varying current of air that modulates the curtain of theatrical smoke produced by the console 102 in a manner that simulates the action of a flame or fire; and using the lighting assembly 106 to produce a flood of light that interacts with the modulated theatrical smoke curtain produced by the operation of the console 102 and the air modulator 104 to produce a simulated flame or fire effect.

The theatrical smoke provided to the console 102 of the device 100 is produced by a theatrical smoke machine 162 and conveyed to the console 102 by piping 164. For the theatrical smoke produced by the machine 162 to be conveyed by the piping 164 to the console 102, the machine 162 is not directly connected to the piping 164. Typically, there is a 3" to 5" gap 165 between the outlet of the machine 162 and the inlet of the piping 164. The amount of smoke produced by the machine 162 is typically varied using a control interface that is supplied with or part of the machine. A blower 168 produces the stream of gas that is provided to the console 102 via piping 170. The height of the curtain of theatrical smoke that is produced adjacent to the outlet port 122 of the console 102 is determined by the blower. If a constant output blower is utilized, the height of the curtain can be adjusted by blocking the blower intake. Alternatively, if a variable-speed blower is used, the height of the curtain can be adjusted by adjusting the speed of the blower.

A control and electrical power distribution system, similar to the system 78 used with the steam embodiment of the device, distributes power to the air modulator 104, the lighting assembly 106, smoke machine 162, and blower 164. The system also includes the electronic circuitry for causing the lights of the lighting assembly to flicker or change in intensity. Further, to the extent possible, the system allows a user to control the smoke machine 162 and the blower 164.

A number of modifications to the device 100, in addition to any already noted, are feasible. For instance, the relative positions of the console 102, air modulator 104 and lighting assembly 106 can be changed from those shown in the drawings to address particular applications of the device 100. Another possible modification is to use a slot rather than the holes in either or both of the elongated tubes.

Figure 12:
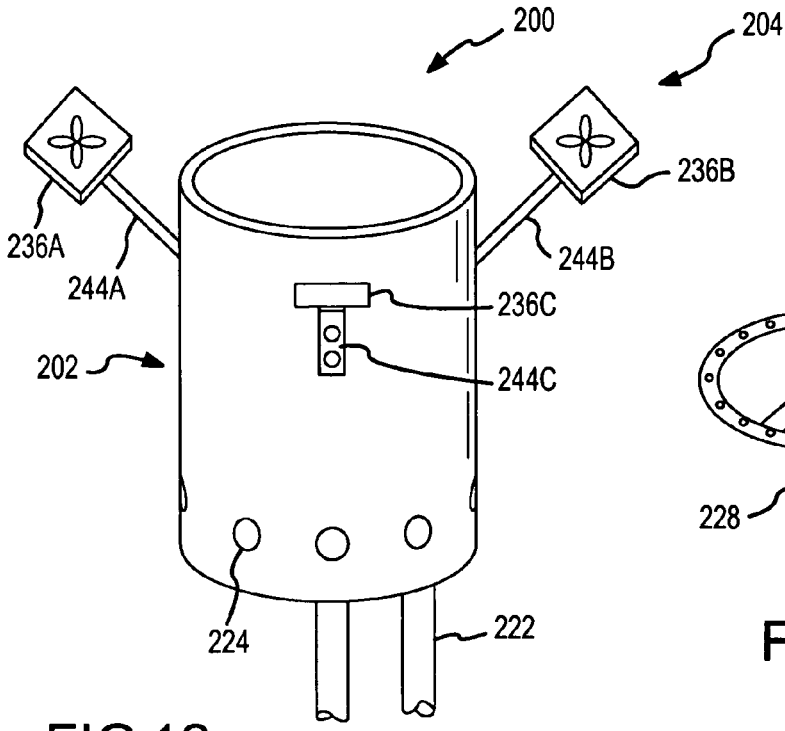
FIG. 12 is a perspective view of an embodiment of a special effect device for producing a simulated flame or fire effect using a cloud of steam and that is particularly useful in applications in which a target viewer is typically able to inspect the device from relatively close range.

FIG. 12 illustrates an embodiment of a special effect device, which is hereinafter referred to as device 200, that uses steam to produce a simulated flame or fire effect and that is particularly useful in applications in which target viewers are typically capable of inspecting the device from relatively close range. A target viewer is an individual that is a member of the audience for whom the illusion is being created and who is of normal height and who resides in the area set aside for the audience and who does not engage in any extraordinary measures (e.g., standing on the seat of a chair) to inspect the device 200.

Figure 13B:
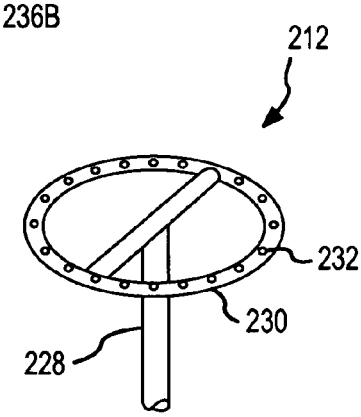
FIG. 13B is a perspective view of the steam emission manifold illustrated in FIG. 13.
Figure 13C:
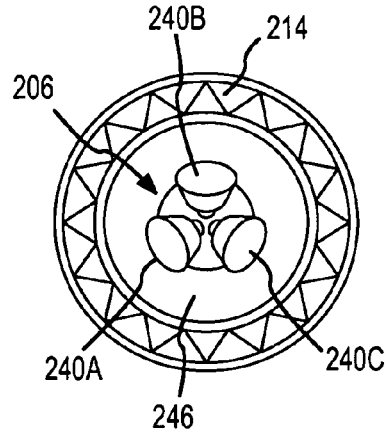
FIG. 13C is a plan view of the device shown in FIG. 13.
Figure 13A:
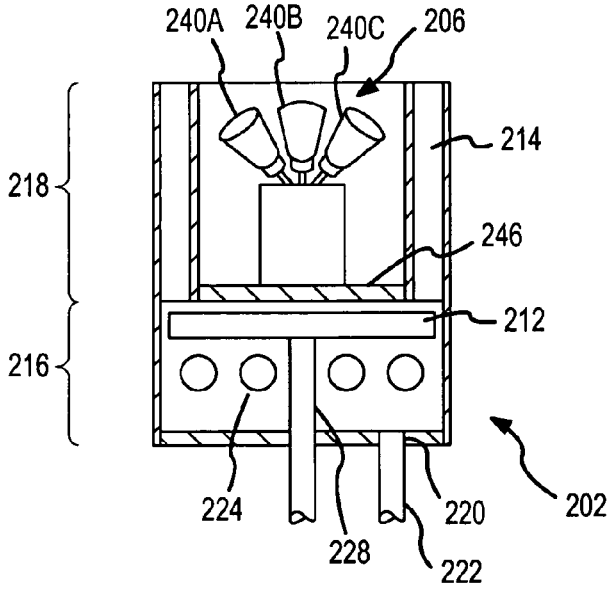
FIG. 13A is a partial cross-sectional view of the device (less the structure relating to the air modulator) illustrated in FIG. 12.

With reference to FIGS. 13A–13C and continuing reference to FIG. 12, the device 200 comprises a steam console 202 for producing a cloud of steam along at least a portion of the length of the console, an air modulator 204 for modulating the cloud of steam of that is produced by the console 202, and a lighting assembly 206 for illuminating the modulated cloud of steam produced by the console 202 and air modulator 204 to achieve the simulated flame.

With reference to FIGS. 13A–13C, the steam console 202 comprises housing 210 for holding a steam emission manifold 212 and a flow straightener 214. The housing 210 defines a manifold portion 216 for holding the steam emission manifold 212 and an outlet slot portion 218 for holding the flow straightener 214. The manifold portion 216 of the housing 210 is also constructed to collect the condensate that is produced during operation of the device and direct the condensate to a condensate outlet hole 220. Communicating with the condensate outlet hole 220 is a drainage pipe 222 that allows condensate to be directed to a distal location that is typically out of the view of the target viewer. Typically, the drainage pipe feeds into a conventional sewage drain or reservoir at the distal location. The manifold portion 216 also has a number of air entrainment holes 224 that, during operation, allow air to enter the housing and cool the steam being vented from the steam emission manifold to facilitate the production of the steam cloud adjacent to the outlet slot portion 218. The air entrainment holes 224 are located so that, during operation of the device 200, the holes 224 are at a higher elevation above the ground than the condensate outlet hole 220. This ensures that condensate drains through the condensate outlet hole 220 and the drainage pipe 222 to a distal location, instead of out of one of the air entrainment holes 224.

With reference to FIG. 13B, the steam emission manifold 212 is comprised of an inlet T-section 228 and a torus 230 that has a plurality of holes 232. In operation, the upright leg of the T-section 228 receives steam and the cross-member section of the T-section 228 distributes the received steam to the torus 230 via inlets to the torus 230 that are located substantially diametrically opposite of one another. The steam received by the torus 230 is vented via the holes 232, which are located so that the steam will pass through the flow straightener 214 in the outlet slot portion 218 of the housing 210. It should be appreciated that other configurations of steam emission manifolds can be employed. For instance, semi-circular, cross and chevron shaped manifolds are feasible. Relatedly, steam manifolds with different configurations will typically employ housings with shapes other than the cylindrical shape in the illustrated embodiment. Further, in the illustrated embodiment, the holes 232 in the torus 230 are substantially identical to one another and equally spaced from one another. For a torus with a diameter of approximately 8 inches and a cross-sectional diameter of about one-half inch, such holes have been found to produce a steam cloud with a substantially uniform steam density. For manifolds with different dimensions or that need to achieve a particular steam density profile, it may be necessary to modify the size and/or location of the holes as noted with respect to the device 10.

The flow straightener 214, absent the application of the air modulator 204, facilitates the production of a relatively smooth curtain of steam, i.e., the steam cloud produced adjacent to the outlet slot portion 218 during operation of the device 200 flows substantially directly upward. The flow straightener 214, like the flow straightener associate with device 10, is preferably designed to reduce condensation that reduces the amount of steam available to produce the cloud of steam during operation of the device.

The air modulator 204 is comprised of three box-type fans 236A–236C, which are commonly used to cool lap-top computers and the like. It should be appreciated that the invention is not limited to the use of a particular type of fan. Moreover, if multiple fans are employed, it is not necessary that the fans be of the same type. Further, in certain applications, it may only be necessary or desirable to use one fan in producing the desired simulated flame or fire effect. In the illustrated embodiment, the fans 236A–236C produce an airflow that is sufficiently random for the purpose of producing a simulated flame or fire effect. If greater randomness in the air flow produced by the fans 236A–236C is needed, the current flow to the fans can be modulated using a micro-controller, power line communication ("PLC") circuitry, or any other device known to those skilled in the art. As noted with respect to device 10, other types of devices are capable of modulating the cloud of steam. For example, in certain applications, an air amplifier may be feasible.

The lighting assembly 206 is used to produce the light that is directed to the modulated cloud of steam produced by the steam console 202 and air modulator 204 to produce the flame or fire special effect. The lighting assembly 206 is comprised lights 240A–240C. As with the lighting system 16 that is associated with device 10, the lights 240A–240C employ colored filters that are chosen so as that the colors of a flame are produced in a naturally occurring sequence (e.g. red at the bottom, followed by orange, and yellow at the top). Flicker devices are used to modulate the intensity of the lights 60. In one embodiment, there is a flicker device associated with each of the lights 60 so that the lights do not flicker in synchronism but rather flicker in a quasi-random manner. In the illustrated embodiment, each of the lights 240A–240C is comprised of an MR-16 lamp. However, it should be appreciated that the invention is not limited to the use of a particular type of lamp. For example, LED arrays can be used in place of the lights 240A–240C. Other lighting devices known to the skilled in the art are also feasible. Further, if multiple lighting devices are employed in a particular embodiment, it is not necessary that the devices be of the same type. Moreover, in certain applications, a single lighting device may be desirable or feasible.

The device 200 further comprises support surfaces for supporting the fans 236A–236C and lights 240A–240C and operatively connecting the steam console 202, the fans 236A–236C, and lights 240A–240C to one another. Specifically, the fans 236A–236C are respectively connected to the outer side of the housing 210 by fan supports 244A–244C. The lights 240A–240C are connected to the inner side of the housing 210 by a light support 246. The fan supports 244A–244C and light support 246 facilitate the integration of the steam console 202, fans 236A–236C, and lights 240A–240C into a modular unit that is particularly suitable for applications in which: (a) target viewers of the illusion are able to inspect the device from relatively close range; and (b) the air modulator and lighting system cannot be located or mounted on the surfaces normally present, such as floors and walls, and still reasonably maintain the illusion of a flame relative to the various locations from which the target audience is able to view the flame produced by the device. Examples, of such applications are wall sconces and torchieres.

The device 200 further comprises electrical control and electrical power distribution circuitry substantially identical to that employed with device 10. Consequently, the control and power distribution circuitry associated with the device 200 will not be described further. Furthermore, the operation of the device 200 is also substantially identical to that of device 10. As such, the operation of the device 200 will not be described further.

Figure 14:
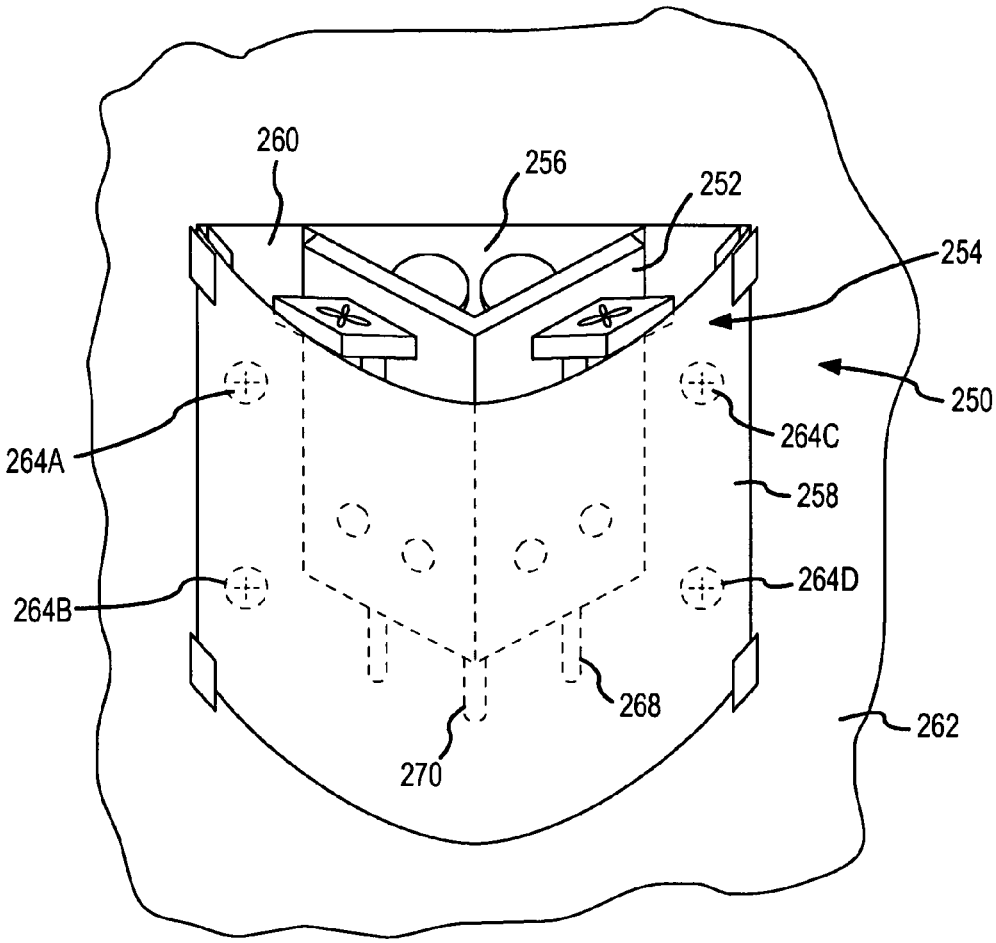
FIG. 14 illustrates a second embodiment of a special effect device for producing a simulated flame or fire effect using a cloud of steam and that is particularly useful in a sconce application in which a target viewer is typically able to inspect the device from relatively close range.

With reference to FIG. 14, a second embodiment of a special effect device, hereinafter referred to as device 250, for producing a simulated flame or fire effect using a cloud of steam and that is particularly useful in an application in which a target viewer is typically able to inspect the device from relatively close range, the application in this case being a sconce. The device 250 is comprised of a steam console 252, an air modulator 254, and a lighting system 256. The device 250 is further comprised of a cover 258 that prevents a target viewer from seeing the steam console 252, air modulator 254, and lighting system 256 that are used to produce the simulated flame or fire effect. The fans associated with the air modulator 254 and the lights associated with the lighting system 256 are, like the comparable elements in device 200, operatively attached to the housing of the steam console 252 by support structures. Further comprising the device 250 is a mounting panel 260 that allows the device 250 to be attached to a wall 260 by screws 264A–264D. The mounting panel 258 also provides clips 266A–266D that support the cover 258. A drainage pipe 268 communicates with a condensate outlet hole associated with the steam console 252. The drainage pipe 268 passes through the wall 260 and is shielded from the view of a target viewer by the cover 258. Similarly, a steam inlet pipe 270 that communicates with the inlet port of the steam manifold associated with the steam console 252 passes through the wall 260 and is shielded from the view of a target viewer by the cover 258.

It should be appreciated that the steam console 252 of the device 250 has a different shape than the steam console 202 associated with the device 200. Specifically, the steam console 252 has a chevron shape; the steam console 202, in contrast, has a circular shape. Further, it should be appreciated that the air modulator 254 associated with the device 250 has a different number of fans than the air modulator 204 associated with the device 200. Additionally, the lighting system 256 has a different number of lights than the lighting assembly 206 associated with the device 200.

Figure 15:
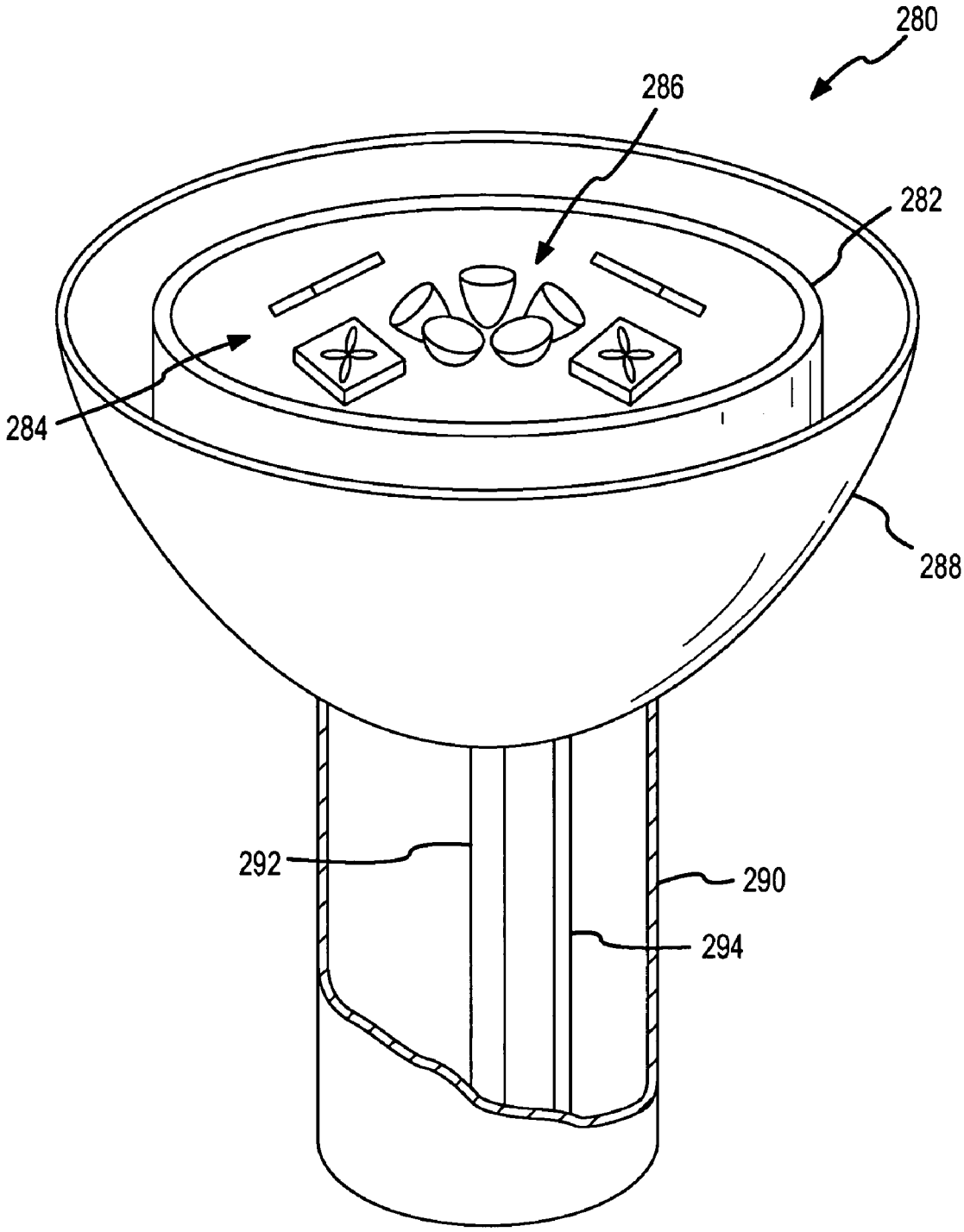
FIG. 15 illustrates a third embodiment of a special effect device for producing a simulated flame or fire effect using a cloud of steam and that is particularly useful in a torchiere application in which a target viewer is typically able to inspect the device from relatively close range.

With reference to FIG. 15, a third embodiment of a special effect device, hereinafter referred to as device 280, for producing a simulated flame or fire effect using a cloud of steam and that is particularly useful in an application in which a target viewer is typically able to inspect the device from relatively close range and from 360 degrees, the application in this case being a torchiere. The device 280 is comprised of a steam console 282, an air modulator 284, and a lighting system 286. The device 280 is further comprised of a cover 288 that prevents a target viewer from seeing the steam console 282, air modulator 284, and lighting system 286 that are used to produce the simulated flame or fire effect. The exterior of the cover 288 may be treated to produce a theme effect. For example, the exterior of the cover 288 may be treated so as to appear to be a brass or copper bowl to the target viewer. In the illustrated embodiment, the dimensions of the steam console 282 are such that the fans associated with the air modulator 254 and the lights 256 associated with the lighting system 256 are capable of being accommodated within the inner wall of the housing of the steam console 282. As such, the fans and lights are operatively connected to the housing by a single support structure comparable to the light support 246 associated with the device 200. Further comprising the device 280 is a hollow, cylindrical support 290 that serves to: (a) support the steam console 282, air modulator 284, lighting assembly 286, and cover 288; and (b) obscure a steam inlet pipe 292 and a drainage pipe 294 from the view of a target viewer.

It should be appreciated that in embodiments in which the steam console, such as steam console 282, is capable of preventing a target viewer from viewing the air modulator and lighting assembly, a cover may not be needed. Moreover, in embodiments in which it may be possible to dispense with a cover, it may be possible to treat the exterior surface of the housing of the steam console to produce a theme effect. It should be further appreciated that, although the device 280 utilizes a hollow, cylindrical support, other support structures which substantially prevent a target viewer from viewing the steam inlet and drainage pipe are feasible. For example, in certain applications, a flat panel or curved shell is capable of providing the necessary support and shielding the steam inlet and drainage pipe from a target viewer.

Figure 16:
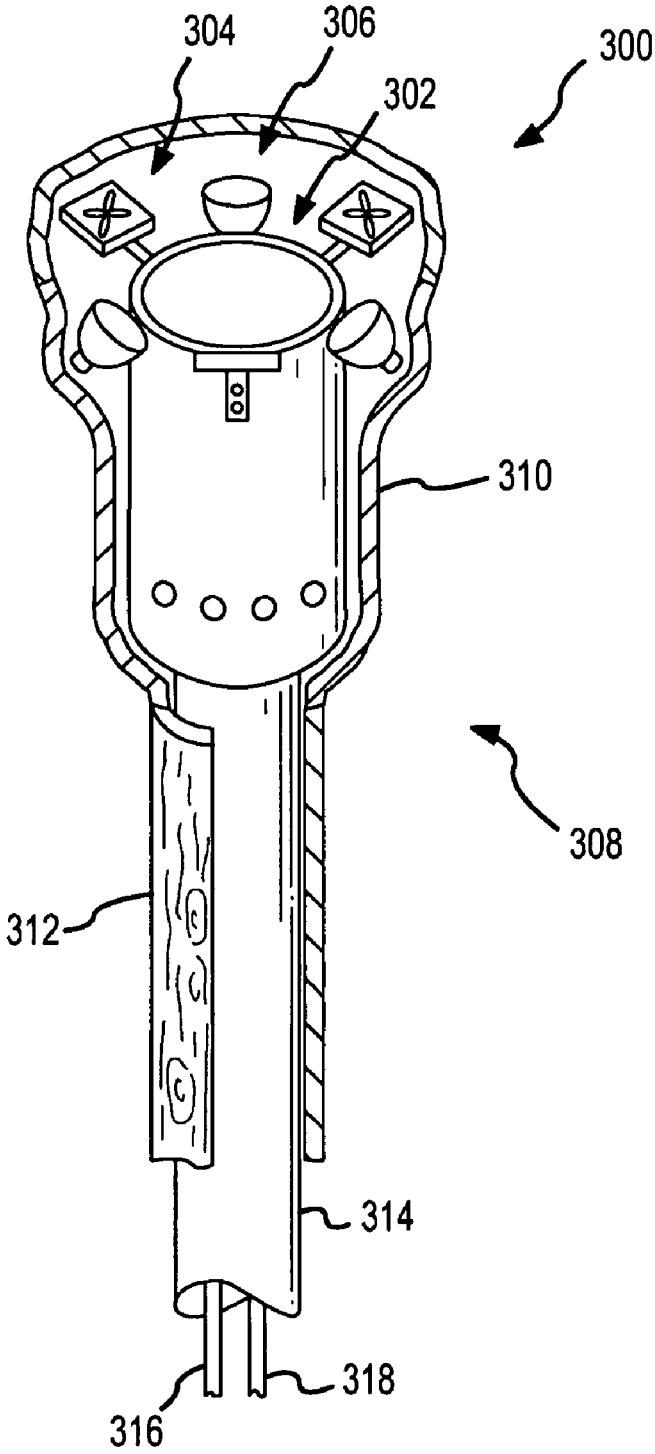
FIG. 16 illustrates a fourth embodiment of a special effect device for producing a simulated flame or fire effect using a cloud of steam and that is particularly useful in a medieval torch application in which a target viewer is typically able to inspect the device from relatively close range.

With reference to FIG. 16, a fourth embodiment of a special effect device, hereinafter referred to as device 300, for producing a simulated flame or fire effect using a cloud of steam and that is particularly useful in an application in which a target viewer is typically able to inspect the device from relatively close range, the application in this case being a medieval torch. The device 300 is comprised of a steam console 302, an air modulator 304, and a lighting system 306. The device 300 is further comprised of a cover 308 that prevents a target viewer from seeing the steam console 282, air modulator 284, and lighting system 286 that are used to produce the simulated flame or fire effect. The cover 308 is comprised of a first cover portion 310 that is designed to resemble the wick portion of the torch and a second cover portion 312 that is designed to resemble the wooden handle portion of the torch. In the illustrated embodiment, the dimensions of the steam console 302 are such that the fans associated with the air modulator 304 and the lights 306 associated with the lighting system 256 are incapable of being accommodated within the inner wall of the housing of the steam console 302. As, such the fans and lights are each operatively connected to the exterior side of the housing by separate support structures. Further comprising the device 300 is a hollow, cylindrical support 314 that serves to: (a) support the steam console 302, air modulator 304, and lighting assembly 306; and (b) obscure a steam inlet pipe 316 and a drainage pipe 318 from the view of a target viewer.

It should be appreciated that, in certain applications, it may be possible to treat the exterior surface of a support structure, such as the hollow, cylindrical support 314, to create a theme effect. For example, the exterior of such a support 314 can be painted so as to resemble wood. For target viewers that are not able to get very close to the device, this may be sufficiently convincing.

The embodiments of the invention described hereinabove are intended to describe the best mode known of practicing the invention and to enable others skilled in the art to utilize the invention.

What is claimed is:

1. A special effect device that utilizes steam to create a simulated fire effect comprising:
   - a housing that defines an outlet slot and an interior volume;
   - a steam emission manifold substantially located within said interior volume and comprising a hollow body, an inlet port for providing steam to an interior space of said hollow body, and an outlet structure for venting steam from said interior space of said hollow body;
   - an air modulator for producing a flow of air for altering the position of a steam cloud produced adjacent to said outlet port;
   - a lighting system for projecting light onto a steam cloud produced adjacent to said outlet port; and
   - a drainage pipe that is capable of conveying condensate from a condensate hole in said housing to a distal location.

2. A special effect device, as claimed in claim 1, wherein: said housing comprises an air entrainment hole.

3. A special effect device, as claimed in claim 2, wherein: when said housing is operatively positioned, said air entrainment hole is located at a higher elevation than said condensate hole.

4. A special effect device, as claimed in claim 1, wherein: said housing comprises an exterior theme surface.

5. A special effect device, as claimed in claim 1, further comprising:
   - a theme surface located adjacent to said housing.

6. A special effect device, as claimed in claim 1, further comprising:
   - a support located adjacent to said housing and capable of supporting at least one of said drain pipe and said inlet port for said steam emission manifold.

7. A special effect device, as claimed in claim 6, wherein: said support has an exterior theme surface.

8. A special effect device, as claimed in claim 6, further comprising:
   - a theme surface located adjacent to said support.

9. A special effect device, as claimed in claim 1, further comprising:
   - a hollow support located adjacent to said housing and capable of supporting, within said hollow support, at least one of said drain pipe and a steam pipe that engages said inlet port of said steam emission manifold.

10. A special effect device, as claimed in claim 1, further comprising:

an engagement structure for connecting said housing, steam emission manifold, air modulator, and lighting system to a surface.

11. A special effect device, as claimed in claim 1, further comprising:

a mounting surface that is operatively attached to said housing;

wherein said air modulator and said lighting system are operatively attached to said mounting surface.

12. A special effect device, as claimed in claim 1, further comprising:

a bowl-like structure having a peripheral edge;

wherein said housing, steam emission manifold, air modulator, and lighting system are substantially located within said peripheral edge.

13. A special effect device that utilizes steam to create a simulated fire effect comprising:

a housing that defines an outlet slot and an interior volume;

a steam emission manifold substantially located within said interior volume and comprising a hollow body, an inlet port for providing steam to an interior space of said hollow body, and an outlet structure for venting steam from said interior space of said hollow body;

an air modulator for producing a flow of air for altering the position of a steam cloud produced adjacent to said outlet port;

a lighting system for projecting light onto a steam cloud produced adjacent to said outlet port;

a drainage pipe that is capable of conveying condensate from a condensate hole in said housing to a distal location; and a mounting surface that is operatively attached to said housing;

wherein said air modulator and said lighting system are operatively attached to said mounting surface.

14. A special effect device, as claimed in claim 13, wherein:

said outlet slot being defined by a first housing side and a second housing side that is spaced from said first housing side; and said mounting surface is located adjacent to said first housing side and separated from said second housing side by said first housing side.

15. A special effect device, as claimed in claim 13, wherein:

said outlet slot being defined by a first housing side and a second housing side that is spaced from said first housing side; and said mounting surface is comprised of a first mounting surface and a second mounting surface that is separated from said first mounting surface;

wherein said first mounting surface is located adjacent to said first housing side and separated from said second housing side by said first housing side;

wherein said second mounting surface is located adjacent to said second housing side and separated from said first housing side by said second housing side.

16. A special effect device, as claimed in claim 13, wherein:

said outlet slot being defined by a first housing side and a second housing side that is spaced from said first housing side;

said outlet slot having a first point and a second point that is separated from said first point;

wherein a line extending between said first and second points is not collinear with said outlet slot;

wherein said line is separated from said second housing side by said first housing side;

wherein said mounting surface is located adjacent to said first housing side and separated from said second housing side by said first housing side.

17. A special effect device, as claimed in claim 13, wherein:

said outlet slot being defined by a first housing side and a second housing side that is spaced from said first housing side;

said outlet slot having a first point and a second point that is separated from said first point;

said mounting surface is comprised of a first mounting surface and a second mounting surface that is separated from said first mounting surface;

wherein a line extending between said first and second points is not collinear with said outlet slot;

wherein said line is separated form said second housing side by said first housing side;

wherein said first mounting surface is located adjacent to said first housing side and separated from said second housing side by said first housing side;

wherein said second mounting surface is located adjacent to said second housing side and separated from said first housing side by said second housing side.

18. A special effect device, as claimed in claim 13, wherein:

said outlet slot being defined by a first housing side and a second housing side that is spaced from said first housing side;

said outlet slot defining a curve with a concave side and a convex side;

wherein said first housing side being on said concave side of said curve;

wherein said mounting surface is located adjacent to said first housing side and separated from said second housing side by said first housing side.

19. A special effect device, as claimed in claim 13, wherein:

said outlet slot being defined by a first housing side and a second housing side that is spaced from said first housing side;

said outlet slot defining a curve that has a concave side and a convex side;

wherein said first housing side being on said concave side of said curve;

wherein said second housing side being on said convex side of said curve;

wherein said mounting surface is comprised of a first mounting surface and a second mounting surface that is separated from said first mounting surface;

wherein said first mounting surface is located adjacent to said first housing side and separated from said second housing side by said first housing side;

wherein said second mounting surface is located adjacent to said second housing side and separated from said first housing side by said second housing side.

20. A special effect device, as claimed in claim 13, wherein:

said outlet slot being defined by a first housing side and a second housing side that is spaced from said first housing side;

wherein said outlet slot substantially encloses an area;

wherein said first housing side is closer to said area than said second housing side;

wherein said mounting surface is located adjacent to said first housing side.

21. A special effect device, as claimed in claim 13, wherein:

said outlet slot being defined by a first housing side and a second housing side that is spaced from said first housing side;

wherein said outlet slot substantially encloses an area;

wherein said first housing side is closer to said area than said second housing side;

wherein said mounting surface is comprised of a first mounting surface and a second mounting surface that is separated from said first mounting surface;

wherein said first mounting surface is located adjacent to said first housing side and separated from said second housing side by said first housing side;

wherein said second mounting surface is located adjacent to said second housing and separated from said first housing side by said second housing side.

22. A special effect device, as claimed in claim 13, wherein:

said housing is substantially cylindrical.

23. A special effect device, as claimed in claim 22, wherein:

said housing is less than about 12 inches in diameter.

24. A special effect device, as claimed in claim 22, wherein:

said housing is greater than about 12 inches in diameter.

25. A special effect device, as claimed in claim 13, further comprising:

a bowl-like structure having a peripheral edge;

wherein said housing, steam emission manifold, air modulator, and lighting system are substantially located within said peripheral edge.

26. A special effect device that utilizes steam to create a simulated fire effect comprising:

a housing that defines an outlet slot and an interior volume;

a steam emission manifold substantially located with said interior volume and comprising a hollow body, an inlet port for providing steam to an interior space of said hollow body, and an outlet structure for venting steam from said interior space of said hollow body;

an air modulator for producing a flow of air for altering the position of a steam cloud produced adjacent to said outlet port;

a lighting system for projecting light onto a modulated steam cloud produced adjacent to said outlet port;

a mounting surface that is operatively attached to said housing;

a cover structure for, when the special effect device is in operation, preventing a typical target viewer from viewing said housing, steam emission manifold, air modulator, and lighting system;

wherein at least a portion of said mounting surface is located between said housing and said cover;

wherein at least one of said air modulator and lighting system is operatively attached to said at least a portion of said mounting surface.

27. A special effect device, as claimed in claim 26, wherein:

said air modulator and said light system are operatively attached to said at least a portion of said mounting surface.

28. A special effect device, as claimed in claim 26, wherein:

said mounting surface comprises a first mounting surface and a second mounting surface that is separated from said first mounting surface by said housing;

wherein said first mounting surface comprises said at least a portion of said mounting surface;

wherein one of said air modulator and lighting system is operatively attached to said first mounting surface;

wherein the other of said air modulator and lighting system is operatively attached to said second mounting surface.

29. A special effect device, as claimed in claim 26, wherein:

said cover structure comprises a bowl-like structure.

30. A special effect device, as claimed in claim 26, wherein:

said cover structure comprises a sconce-cover structure.

31. A special effect device, as claimed in claim 26, wherein:

said outlet slot is curved.

32. A special effect device, as claimed in claim 26, further comprising:

a drainage pipe that is capable of conveying condensate from a condensate hole in said housing to a distal location.

* * * * *